US006066387A

United States Patent [19]

Ueda et al.

[11] Patent Number: 6,066,387

[45] **Date of Patent: *May 23, 2000**

[54] RECORDING SHEET FOR INK-JET RECORDING

[75] Inventors: Yutaka Ueda; Ichiro Tsuchiya; Kenji Kuwae; Koji Takemura; Hiroyuki Uemura, all of Hino, Japan

[73] Assignee: Konica Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/802,752

[22] Filed: Feb. 20, 1997

[30] Foreign Application Priority Data

| | | | |
|---|---|---|---|
| Feb. 26, 1996 | [JP] | Japan | 8-038095 |
| Mar. 19, 1996 | [JP] | Japan | 8-062703 |
| Mar. 19, 1996 | [JP] | Japan | 8-062705 |

[51] Int. Cl.[7] ..... B41M 5/00

[52] U.S. Cl. ..... 428/212; 428/195; 428/478.2; 428/500; 428/522

[58] Field of Search ..... 428/195, 478.2, 428/428.6, 212, 500, 522

[56] References Cited

U.S. PATENT DOCUMENTS

| | | | |
|---|---|---|---|
| 4,371,582 | 2/1983 | Sugiyama et al. | 428/500 |
| 4,946,741 | 8/1990 | Aono et al. . | |
| 5,141,599 | 8/1992 | Jahn et al. . | |
| 5,254,403 | 10/1993 | Malhotra . | |
| 5,352,503 | 10/1994 | Drake et al. . | |
| 5,478,631 | 12/1995 | Kawano et al. | 428/195 |

FOREIGN PATENT DOCUMENTS

| | | |
|---|---|---|
| 0445327 | 9/1991 | European Pat. Off. . |
| WO 9402325 | 2/1994 | WIPO . |

OTHER PUBLICATIONS

Search Report EP 97 30 1222 with Annex (3 pages).

Patent Abstracts of Japan Publication #61092885, Publication date: Oct. 5, 1986 (1 page).

*Primary Examiner*—Pamela R. Schwartz

*Attorney, Agent, or Firm*—Jordan B. Bierman; Bierman, Muserlian and Lucas

[57] ABSTRACT

A recording sheet for ink-jet recording is disclosed which comprises a support, and provided thereon, an ink receiving layer, wherein the ink receiving layer contains a water soluble polymer, a polymer latex and gelatin.

10 Claims, No Drawings

RECORDING SHEET FOR INK-JET RECORDING

FIELD OF THE INVENTION

The present invention relates to a recording sheet for ink-jet recording and a method for ink-jet recording, and particularly to a recording sheet for ink-jet recording which can provide an excellent image under various conditions and an excellent transportability.

BACKGROUND OF THE INVENTION

Recently, following the proliferation of personal computers, ink-jet recording system printers are rapidly spreading. Specifically, in the field of graphic art and designing requiring its high quality image, its utilization is being taken notice.

As a recording sheet used for ink-jet recording system, conventionally, a recording sheet wherein an ink receiving layer (hereinafter, referred also to as "ink-absorption layer") is provided on ordinary paper or a support referred to as an ink-jet recording paper has been used. However, when the above-mentioned recording papers are employed, much ink blurring results and glossiness is low. Therefore, the above-mentioned recording papers could not be employed for the above-mentioned field wherein high resolution and high glossiness is required.

In addition, when a transparent support is used to produce an original for an OHP (over-head projector), there was the problem that a porous ink-absorption layer interferred light transmittance.

In order to overcome the above-mentioned problems, there is proposed a gelatin containing layer as an ink-absorption layer with high transparency and high ink-receptivity. For example, for a layer with high ink-absorption, the use of gelatin is disclosed in Japanese Patent Publication Open to Public Inspection (hereinafter, referred to as Japanese Patent O.P.I. Publication) No. 59-255131, and an ink receiving layer comprised of gelatin having a specific pH in Japanese Patent O.P.I. Publication No. 62-263084. A combination use of acid processed gelatin and a fluorine-containing surfactant is disclosed in Japanese Patent O.P.I. Publication No. 1-146784. In Japanese Patent O.P.I. Publication No. 6-64306 is proposed a recording sheet obtained by coating a gelatin layer on a support to be in gel state and then drying it by a cold drying method.

As disclosed in the above-mentioned publications, the ink jet recording sheet having an gelatin containing ink receiving layer provided improved ink absorption, however, it has been proved that, when printing is carried out using a high speed printing printer with high resolution capability, the technologies disclosed in these publications can not give high quality printing images due to insufficient ink absorption. It has also been proved that, particularly when printing is carried out under low temperature and high humidity conditions, the degree of swell of gelatin by the ink is reduced and ink absorption is greatly lowered.

It has been found that glossiness at high density image portions or transparency is lowered, when printing according to the technologies described above is carried out using some kinds of ink jet printers and some kinds of inks.

The physical properties of the ink receiving layer containing gelatin greatly varies depending on temperature or humidity. The layer expands or contracts, depending on humidity change, whereby the recording sheet is curled and results in transporting failure. There are also likely to occur problems in that, during storage under high humidity, the gelatin absorbs moisture and the recording sheets stick to each other or ink is transferred to the back of the upper sheet.

SUMMARY OF THE INVENTION

A first object of the present invention is to provide a recording sheet for ink-jet recording with excellent ink absorption, glossiness and transparency, while minimizing unevenness of printed images.

A second object of the present invention is to provide a recording sheet for ink-jet recording giving high quality images with excellent gradation and without deterioration of glossiness.

A third object of the present invention is to provide recording sheets for ink-jet recording without sticking to each other, without ink transfer to the back of the upper sheet during storage, and without deterioration of printing capability under low temperature or high humidity condition.

DETAILED DESCRIPTION OF THE INVENTION

The above objects of the invention can be attained by the following:

1. A recording sheet for ink-jet recording comprising a support, and provided thereon, an ink receiving layer, wherein the ink receiving layer contains at least one water soluble polymer, at least one polymer latex and gelatin.
2. The recording sheet for ink-jet recording of 1 above, wherein the water soluble polymer is a polyalkylene oxide.
3. The recording sheet for ink-jet recording of 1 or 2 above, wherein the polymer latex content A ($g/m^2$) of the ink receiving layer and the gelatin content B ($g/m^2$) of the ink receiving layer satisfy the following inequality:

$$0.1<A/B<2.0$$

4. The recording sheet for ink-jet recording of 2 or 3 above, wherein the polyalkylene oxide is polyethylene glycol.
5. The recording sheet for ink-jet recording of 4 above, wherein the polyethylene glycol has an average molecular weight of 10,000 to 500,000.
6. The recording sheet for ink-jet recording of 5 above, wherein the polyethylene glycol has an average molecular weight of 50,000 to 300,000.
7. The recording sheet for ink-jet recording of 1, 2, 3, 4, 5 or 6 above, wherein the ink receiving layer consists of plural layers.
8. The recording sheet for ink-jet recording of 2, 3, 4, 5, 6 or 7 above, wherein the ink receiving layer consists of plural layers, and the polyalkyleneoxide content Cx (weight %) of an outermost ink receiving layer and the polyalkyleneoxide content Cy (weight %) of an ink receiving layer other than the outermost ink receiving layer satisfy the following inequality:

$$Cx>Cy$$

9. The recording sheet for ink-jet recording of 7 or 8 above, wherein the polyalkyleneoxide and the polymer latex are not substantially present in the same layer.

10. The recording sheet for ink-jet recording of 7, 8 or 9 above, wherein the outermost layer contains the polyalkylene oxide, a first layer between the outermost layer and the support contains a polymer latex and a second layer between the outermost layer and the first layer contains neither polyalkylene oxide nor polymer latex.

11. A recording sheet for ink-jet recording comprising a support, and an ink receiving layer provided thereon and a backing layer provided on the surface of the support opposite the ink receiving layer, each layer containing gelatin and a polymer latex, wherein the gelatin content Ce (weight %) of the ink receiving layer and the gelatin content Cb (weight %) of the backing layer satisfy the following relation:

$$0.3 \leqq Ce/Cb \leqq 2.0$$

12. The recording sheet for ink-jet recording of 1, 2, 3, 4, 5, 6, 7, 8, 9 or 10 above, comprising a support, and an ink receiving layer provided thereon and a backing layer provided on the surface of the support opposite the ink receiving layer, each layer containing gelatin and a polymer latex, wherein the gelatin content Ce (weight %) of the ink receiving layer and the gelatin content Cb (weight %) of the backing layer satisfy the following relation:

$$0.3 \leqq Ce/Cb \leqq 2.0$$

The present invention will be detailed below.

As gelatin used in the invention, any gelatin made from animal collagen can be used, but gelatin made from pig skin, cow skin or cow bone collagen is preferable. The kind of gelatin is not specifically limited, but lime-processed gelatin, acid processed gelatin or gelatin derivatives (for example, gelatin derivatives disclosed in Japanese Patent Publication Nos. 38-4854/1962, 39-5514/1964, 40-12237/1965, 42-26345/1967 and 2-13595/1990, U.S. Pat. Nos. 2,525,753, 2,594,293, 2,614,928, 2,763,639, 3,118,766, 3,132,945, 3,186,846 and 3,312,553 and British Patent Nos. 861,414 and 103,189) can be used singly or in combination. The gelatin derivatives are advantageously used in view of initial ink drying.

The jelly strength of gelatin used in the invention is preferably not less than 150 kg, and more preferably 200 to 300 kg (according to the PAGI method). The jelly strength of gelatin is measured with a bloom gelometer.

The gelatin derivative preferably used in the invention is those in which the amino, imino or carboxy group present in gelatin has a substituent, and preferably those in which the amino group present in gelatin has a substituent. The example of the gelatin derivative in which the amino group present in gelatin has a substituent includes phenylcarbamoylated gelatin.

The above substituent includes the following group:

(a) alkylacyl, arylacyl, for example, acetyl, or substituted or unsubstituted benzoyl, (b) a sulfonyl group such as alkylsulfonyl or arylsulfonyl, (c) a carbamoyl group such as alkylcarbamoyl or arylcarbamoyl, (d) a thiocarbamoyl group such as alkylthiocarbamoyl or arylthiocarbamoyl, (e) a straight-chained or branched alkyl group having 1 to 18 carbon atoms, and (f) an aryl or heterocyclic group such as a substituted or unsubstituted phenyl or naphthyl, pyridyl or furyl.

The gelatin derivative in the invention preferably has an amino group having an acyl group (—$COR^1$) or a carbamoyl group (—$CONR^1R^2$), in which $R^1$ represents a substituted or unsubstituted aliphatic group (for example, an alkyl group having 1 to 18 carbon atoms, an aryl group or an aralkyl group (for example, phenetyl) and $R^2$ represents a hydrogen atom, an aliphatic group, an aryl or aralkyl group. In the invention, it is especially preferable that $R^1$ is an aryl group and $R^2$ is a hydrogen atom.

The example of the substituent in the amino group in the gelatin derivative is listed below, but is not limited thereto.

Example of the substituent in the amino group in the gelatin derivative.

(A-1)

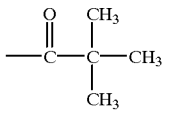

(A-2)

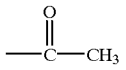

(A-3)

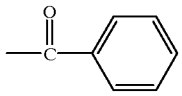

(A-4)

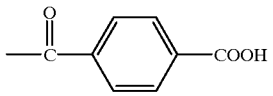

(A-5)

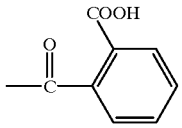

(A-6)

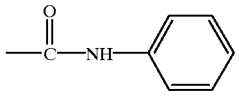

-continued (A-7)

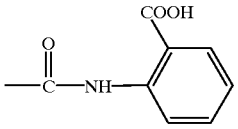

(A-8)

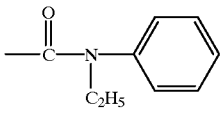

(A-9)

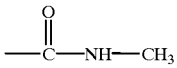

In order to minimize banding in the invention, a gelatin derivative, in which 60% or more, preferably 80% or more of one of the amino and imino group have a substituent, is preferably used.

The substitution rate of the amino group in the gelatin derivative is obtained by measuring the amino group contents before and after substitution of gelatin, and dividing the amino group amount content difference between the amino group before and after substitution with the amino group content before substitution. The quantitative analysis of the amini group can be carried out employing a formol titration method disclosed on page 294 of Bunseki Kagaku binran, the second eddition, eddited by Nihon Bunseki Gakkai.

In the invention, the gelatin content of the ink receiving layer is preferably 3 to 20 g/m$^2$, and more preferably 5 to 15 g/m$^2$.

The water-soluble polymer used in the invention includes polyvinyl alcohol, polyvinyl pyrrolidone, polyvinyl pyridinium halide, modified polyvinyl alcohol such as polyvinyl formal or their derivatives (see Japanese Patent O.P.I. Publication Nos. 145879/1985, 220750/1985, 143177/1986, 235182/1986, 235183/1986, 237681/1986 and 261089/1986), an acryl group-containing polymer such as polyacrylamide, polydimethylacrylamide, polydimethylaminoacrylate, polysodiumacrylate, acrylic acid-methacrylic acid copolymer salt, polysodiummethacrylate or acrylic acid-vinyl alcohol copolymer (disclosed in Japanese Patent O.P.I. Publication Nos. 168651/1985 and 9988/1987), a natural polymer or its derivatives such as starch, oxidation starch, carboxylated starch, dialdehyde starch, cationated starch, dextrin, sodium alginate, gum arabic, casein, pullulan, dextrane, methylcellulose, ethylcellulose, carboxyymethylcellulose or hydroxypropylcellulose (Japanese Patent O.P.I. Publication Nos. 174382/1974, 262685/1985, 143177/1986, 181679/1986, 193879/1986 and 287782/1986), a synthetic polymer such as a polyalkylene oxide (such as polyethylene glycol or polypropylene glycol), polyvinyl ether, polyglycerin, maleic acid-alkylvinylether copolymer, maleic acid-N-vinylpyrrole copolymer, styrene-maleic anhydride copolymer or polyethylene imine (disclosed in Japanese Patent O.P.I. Publication Nos. 61-32787/1986, 61-237680/1986 and 61-277483/1986). Of these, the preferable are a polyalkylene oxide, polyvinyl pyrrolidone, polyvinyl alcohol or a methacrylic acid-acrylic acid copolymer or its salt. The more preferable is a polyalkylene oxide, and the most preferable is polyethylene glycol.

In the invention, the water-soluble polymer content of the ink receiving layer is preferably 0.1 to 10 g/m$^2$.

The polymer latex used in the invention includes a vinyl polymer latex including a homopolymer such as polyvinyl acetate, polystyrene, polyethylene or polyvinyl chloride, an acryl copolymer, a vinyl acetate copolymer and a vinyl chloride copolymer. The synthetic rubber latex used in the invention includes a homopolymer such as a polyisobutylene rubber, a chloroprene rubber or a polybutadiene rubber or a copolymer such as a styrene-butadiene copolymer, a acrylonitrile-butadiene copolymer or a methylmethacrylate-butadiene copolymer. The above latexes include those in which the above polymers are modified with a functional group such as a carboxyl group.

The example of the especially preferable polymer latex is listed below.

Exemplified compound (1)

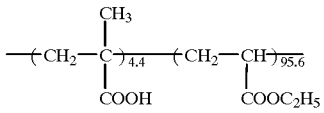

(2)

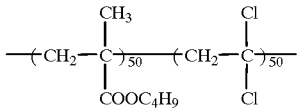

(3)

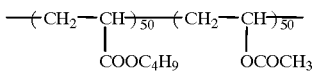

(4)

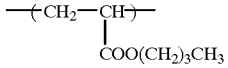

(5)

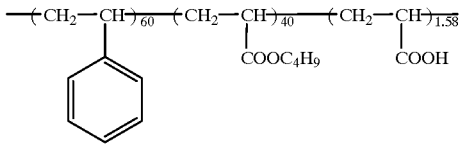

(6)

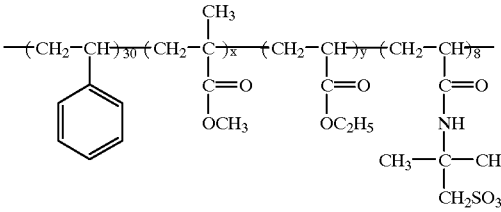

x + y = 62

(7)

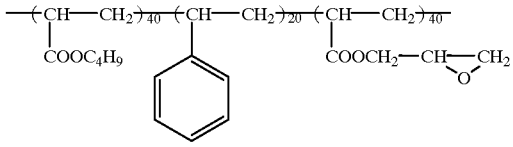

-continued (8)

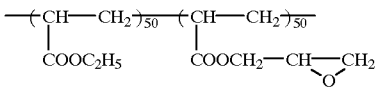

In the invention, the polymer latex content of the ink receiving layer is preferably 0.3 to 40 g/m$^2$.

The invention is effected, when the polymer latex content A of the ink receiving layer and the gelatin content B of the ink receiving layer satisfies the following relation:

$$0.1<A/B<2.0$$

The preferable is 0.2<A/B<1.2.

The polyalkylene oxides include polyethylene oxides, polyethylene glycols, polypropylene glycols and a compound represened by the following formula (P).

$$R_1O—(A_1O)_{j1}—(A_2O)_{j2}—(A_3O)_{j3}—R_2 \qquad \text{formula (P)}$$

wherein $A_1$, $A_2$ and $A_3$ independently represent a substituted or unsubstituted, straight-chained or branched alkylene group, provided that $A_1$, $A_2$ and $A_3$ are not simultaneously the same groups; and $R_1$ and $R_2$ independently represent a hydrogen atom, a substituted or unsubstituted alkyl group, a substituted or unsubstituted aryl group or an acyl group, provided that $R_1$ and $R_2$ may be the same or different.

The substituent includes a hydroxy group, a carboxyl group, a sulfonyl group, an alkoxy group, a carbamoyl group and a sulfamoyl group. It is preferable that $R_1$ and $R_2$ both are hydrogen atoms and $A_1$, $A_2$ and $A_3$ independently represent an unsubstituted alkylene group. It is more preferable that $A_1$, $A_2$ and $A_3$ independently represent —$CH_2CH_2$—or —$CH(CH_3)$—$CH_2$—.

J1, j2 and j3 independently represent an integer of 0 to 500, provided that J1+j2+j3≧5.

At least one of J1, j2 and j3 is preferably 15 or more, and more preferably 20 or more.

When the compound represened by formula (P) is a copolymer having two monomer units A and B, the compound includes a compound having the following structure:

A-B-A-B-A-B-A-B-A-B-,

-A-A-B-A-B-B-A-A-A-B-A-A-B-B-A- or

-A-A-A-A-A-A-B-B-B-B-B-B-A-A-A-A-A-

Of these copolymers, the especially preferable compound includes an ethylene glycol-propylene glycol block copolymer (Pluronic nonion type) represented by the following formula (P'):

$$HO—(CH_2CH_2O)_{j4}—[CH(CH_3)CH_2O]_{j5}—(CH_2CH_2O)_{j6}—H$$

wherein J4, j5 and j6 independently represent the same as denoted in J1, j2 and j3.

In the invention, the average molecular weight of the polyalkylene oxide is preferably 10,000 to 500,000, and more preferably 20,000 to 300,000.

In the invention, the polyalkylene oxide is preferably polyethylene glycol. The average molecular weight of the polyethylene glycol (hereinafter referred to also as PEG) is preferably 10,000 to 500,000, and more preferably 50,000 to 300,000.

The average molecular weight herein referred to means a molecular weight obtained from a hydroxyl value.

In the invention, the ink receiving layer consists of plural layers, and the polyalkyleneoxide content Cx (weight %) of an outermost ink receiving layer and the polyalkyleneoxide content Cy (weight %) of an ink receiving layer other than the outermost ink receiving layer satisfy the following inequality:

$$Cx<Cy,$$

whereby high ink absorption is obtained and ink blurring, which is likely to occur during storage under high humidity condition, is minimized.

The content herein referred to means the content after drying the ink receiving layer.

In the invention, the ink receiving layer consists of plural layers, and the polyalkyleneoxide and the polymer latex are not substantially present in the same ink receiving layer, whereby deterioration of glossiness of printed images, which is likely to occur when using ink containing high organic solvent concentration, can be minimized.

It is preferable that in the recording sheet for ink-jet recording in the invention, the outermost layer contains the polyalkylene oxides, a first layer between the outermost layer and the support contains a polymer latex and a second layer between the outermost layer and the first layer resin contains neither polyalkylene oxides nor polymer latex, whereby the above problems can be further overcome.

The recording sheet for ink-jet recording in the invention minimizes its transporting failure or their sticking to each other, which comprises a support, and an ink receiving layer provided thereon and a backing layer provided on the surface of the support opposite the ink receiving layer, each layer containing gelatin and a polymer latex, wherein the gelatin content Ce (weight %) of the ink receiving layer and the gelatin content Cb (weight %) of the backing layer satisfy the following relation:

$$0.3 \leqq Ce/Cb \leqq 2.0$$

The ink receiving layer in the invention preferably contains a surfactant in order to improve image quality, as long as it jeopardizes ink absorption property. The surfactant includes an anionic, cationic, nonionic or betaine type surfactant, which may be low or high molecular weight. The different kinds of surfactants may be used in combination. The surfactant is preferably a fluorine-containing surfactant. The surfactant content of the ink receiving layer is preferably 0.001 to 5 g, and more preferably 0.10 to 3 g per 100 g of binder.

As an anionic fluorine-containing surfactant preferably used in the present invention, those represented by the following Formula (FA) are cited.

$$(Cf)-(Y)_n \qquad \text{Formula (FA)}$$

wherein Cf represents an n-valent group containing at least 3 fluorine atoms and at least 2 carbon atoms; Y represents a —COOM, —$SO_3M$, —$OSO_3M$ or —P(=O) $(OM)_2$; M represents a hydrogen atom, an alkali metal or a cation such as a quaternary ammonium salt; and n represents 1 or 2.

The example of Cf includes a substituted or unsubstituted alkyl or alkenyl group having 2 to 30 carbon atoms and at least three fluorine atoms or an aryl group with a substituted or unsubstituted alkyl or alkenyl group having 2 to 30 carbon atoms and at least three fluorine atoms.

As an anionic fluorine-containing surfactant preferably used in the present invention, those represented by the following Formula (FA') are cited.

$$Rf\text{-}(D)_t\text{-}Y \qquad \text{Formula (FA')}$$

wherein Rf represents a fluorine-containing alkyl group having 3–30 carbon atoms or an aryl group having a fluorine-containing alkyl group of 3–30 carbon atoms; D represents a divalent group having at least one of —O—, —COO—, —CON($R_1$)—and —$SO_2$N($R_1$)— bond and having 1 to 12 carbon atoms; $R_1$ represents an alkyl group having 1 to 5 carbon atoms; t represents 0, 1 or 2; Y represents —COOM—, —$SO_3$M, —O$SO_3$M or —P(=O)$(OM)_2$; and M represents a hydrogen atom, an alkali metal or a cation such as a quaternary ammonium salt.

Rf preferably represents a fluorine-containing alkyl group having 3 to 10 carbon atoms, D preferably represents a divalent group containing an alkylene group having 1 to 5 carbon atoms and at least one of —O—, —COO—, —CON($R_1$)— and —$SO_2$N($R_1$)—, or a divalent group containing an arylene group and at least one of —O—, —COO—, —CON($R_1$)— and —$SO_2$N($R_1$)— in which $R_1$ represents an alkyl group having 1 to 5 carbon atoms, and Y preferably represents —COOM or —$SO_3$M in which M represents an alkali metal, preferably sodium or potassium.

Next, examples of the compounds represented by Formula (FA) will be illustrated. However, the present invention is not limited thereto.

FA-1

$C_7F_{15}COONH_4$

FA-2

$C_{10}F_{21}(CH_2)_{10}COOH$

FA-3

$C_8F_{17}SO_2N(C_3H_7)CH_2CH_2O(CH_2)_3SO_3Na$

FA-4

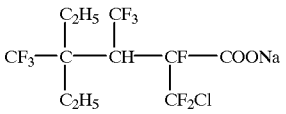

FA-5

$ClCF_2(CFCl)(CF_2)_4COOH$

FA-6

$H(CF_2)_{10}COOH$

FA-7

$HOOC(CF_2CF(Cl))_4COOH$

FA-8

$Cl(CF_2CF(Cl))_3CF_2COOK$

FA-9

$C_5F_{11}CH{=}CH(CH_2)_3COONa$

-continued

FA-10

$C_4F_9CF(CF_3)(CH_2)_{10}COONa$

FA-11

$C_4F_9CON(CH_3)CH_2CH_2COOH$

FA-12

$Cl(CF_2)_6COONa$

FA-13

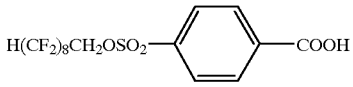

FA-14

$C_{10}F_{21}CH_2CH_2SO_2N(C_2H_5)CH_2COONa$

FA-15

$C_6F_{13}CON(C_2H_5)CH_2COONa$

FA-16

$C_8F_{17}SO_2N(C_3H_7)CH_2CH_2SO_3Na$

FA-17

$C_8F_{17}CON(C_2H_5)CH_2CH_2SO_3Na$

FA-18

$C_8F_{17}SO_2N(C_2H_5)CH_2COONa$

FA-19

$C_8F_{17}SO_2N(C_3H_7)CH_2COOK$

FA-20

$C_8F_{17}SO_2N(CH_3)(CH_2CH_2O)_4(CH_2)_4SO_3Na$

FA-21

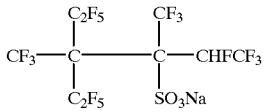

FA-22

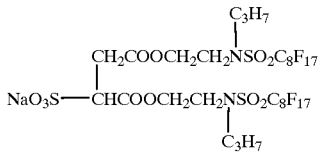

FA-23

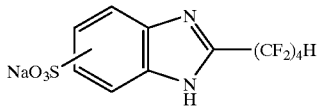

wherein —$SO_3Na$ is a 4- or 5- positioned or mixture thereof

FA-24

$H(CF_2)_6CH_2PO_3H_2$

-continued

FA-25

$H(CF_2)_8PO_3Na_2$

FA-26

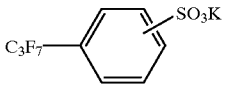

wherein —$SO_3K$ is a -o, -m, or -p-positioned or mixture thereof

FA-27

$C_8F_{17}SO_2N(C_2H_5)(CH_2)_6COOK$

FA-28

$C_{12}F_{25}CH_2OSO_3Na$

FA-29

$C_7F_{15}COO(CH_2)_3SO_3K$

FA-30

$NaO_3S—CH(CH_2COOCH_2(CF_2)_6H)COOCH_2(CF_2)_6H$

FA-31

$C_{16}H_{33}CH(SO_3Na)COOCH_2CF_3$

FA-32

$(CF_3)_2CFO(CF_2)_2CH_2CH(CH_2)_6COONa$
$(CF_3)_2CFO(CF_2)_2CH_2CH(CH_2)_6COONa$

FA-33

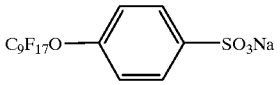

FA-34

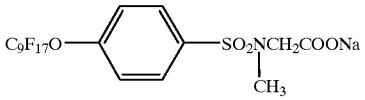

FA-35

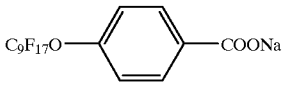

FA-36

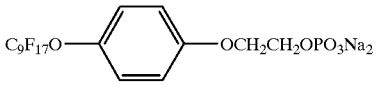

FA-37

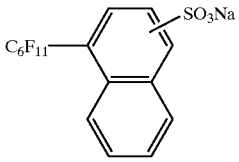

FA-38

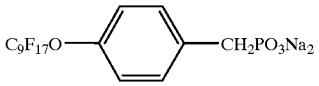

FA-39

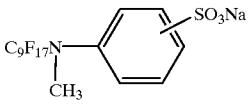

-continued

FA-40

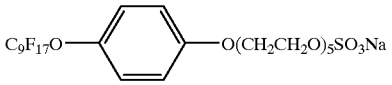

FA-41

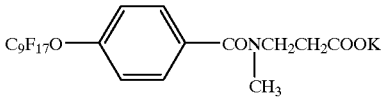

FA-42

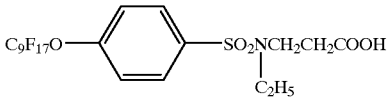

FA-43

$C_9F_{17}OCH_2CH_2OSO_3Na$

FA-44

$C_9F_{17}O(CH_2)_4OPO_3Na_2$

FA-45

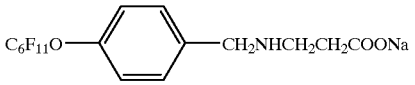

FA-46

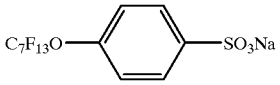

FA-47

$H(CF_2)_7O(CH_2)_3SO_3Na$

FA-48

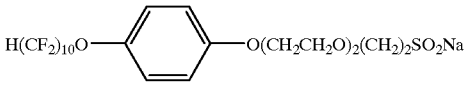

FA-49

$C_8F_{17}SO_2N(C_3H_7)(CH_2CH_2O)_3(CH_2)_3SO_3Na$

Specifically preferable are anionic fluorine-containing surfactants containing at least one —$SO_2N(R_1)$— bond.

Cationic fluorine-containing surfactants used in the present invention are compounds represented by the following Formula (FK):

$$Rf'-L-X^+Z^- \qquad \text{Formula (FK)}$$

wherein Rf' represents a hydrocarbon group having 1 to 20 carbon atoms in which at least one hydrogen atom is substituted by a fluorine atom; L represents a chemical bond or a divalent group; X represents a cation; and Z represents a counter anion.

As examples of Rf', —$C_kF_{k+l}$ ($k$=1 through 20, specifically 3 through 12 are preferable), —$C_mF_{2m-1}$ (m=2 through 20, specifically 3 through 12 are preferable) are cited.

As examples of L, —$SO_2N(R^1)(CH_2)_p$—, —$CON(R^1)(CH_2)_p$—, —$OASO_2N(R^1)(CH_2)_p$—, —$OACON(R^1)(CH_2)_p$—, —$OAO(CH_2)_p$—, —$OA(CH_2)_p$—, —$O(CH_2CH_2O)_q(CH_2)_p$—, —$O(CH_2)_p$—, —$N(R^1)(CH_2)_p$13, —$SO_2N(R^1)(CH_2)_pO(CH_2)_r$—, —$CON(R^1)(CH_2)_pO(CH_2)_r$13, —$OASO_2N(R^1)(CHR^1)_pOA$— and —$(CH_2)_p(CHOH)_s(CH_2)_r$—, in which A represents alkylene or arylene, are cited.

As examples of $X^+$, $—N^+(R^1)_3$, $—N^+(CH_2CH_2OCH_3)_3$, $—N^+C_4H_8O(R^1)$, $—N^+(R^1)(R^2)(CH_2CH_2OCH_3)$, $—N^+C_5H_5$, $—N^+(R^1)(R^2)(CH_2)_pC_6H_5$ and $—N^+(R^1)(R^2)(R^2)$ are cited, wherein $R^1$ and $R^2$ independently represent a hydrogen atom or an alkyl group, which may have a substituent, having 1 to 6 carbon atoms; p, r and s independently represent 0 through 6; and q represents 1 through 20.

As examples of $Z^-$, $I^-$, $Cl^-$, $Br^-$, $CH_3SO_3^-$ and $CH_3—C_6H_4—SO_3^-$ are cited.

Hereunder, examples of the cationic fluorine-containing surfactants preferably used in the present invention will be exhibited. However, the present invention is not limited thereto.

FK-1

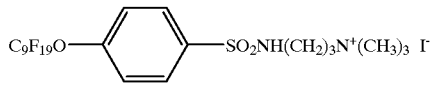

FK-2

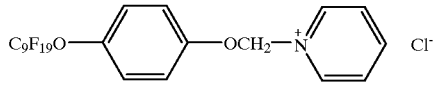

FK-3

$C_7F_{15}CONH(CH_2)_2N^+(CH_3)_3$ $Cl^-$

FK-4

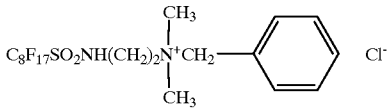

FK-5

$C_2F_5CONH(CH_2)_3N^+(CH_3)_3$ $I^-$

FK-6

$C_{12}F_{23}O(CH_2CH_2O)_5CH_2CH_2N^+(CH_3)_3$ $I^-$

FK-7

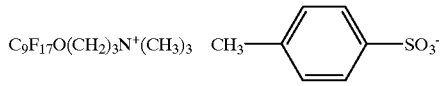

FK-8

$C_8F_{17}SO_2NH(CH_2)_3N^+(CH_3)_3$ $I^-$

FK-9

$C_8F_{17}SO_2NH(CH_2)_3N^+(CH_2CH_2OCH_3)_3$ $I^-$

FK-10

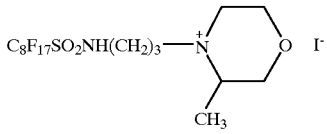

FK-11

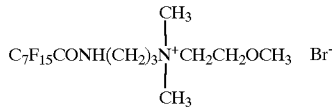

FK-12

$C_9F_{19}CONH(CH_2)_5N^+(CH_3)_3$ $I^-$

-continued

FK-13

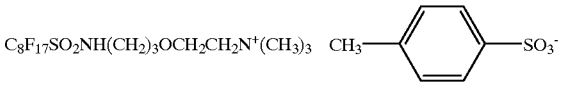

FK-14

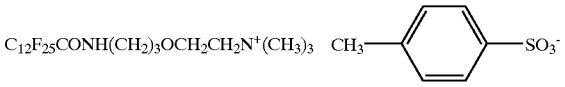

FK-15

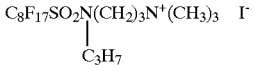

FK-16

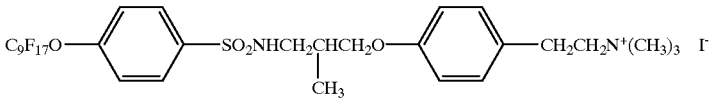

FK-17

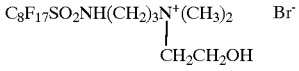

FK-18

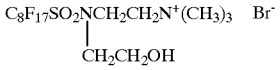

FK-19

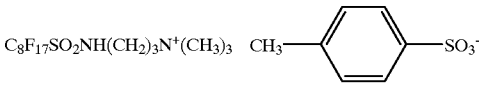

FK-20

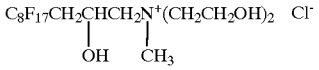

FK-21

The anionic fluorine-containing surfactants or the cationic fluorine-containing surfactants of the present invention can be synthesized by methods described in U.S. Pat. Nos. 2,559,751, 2,567,011, 2,732,398, 2,764,602, 2,806,866, 2,809,998, 2,915,376, 2,915,528, 2,918,501, 2,934,450, 2,937,098, 2,957,031, 3,472,894 and 3,555,089, British Patent Nos. 1,143,927 and 1,130,822, Japanese Patent Publication No. 37304/1970, Japanese Patent O.P.I. Nos. 9613/1972, 134614/1974, 117705/1975, 117727/1975, 121243/1975, 41182/1977 and 12392/1976, J. Chem, Soc., 1950, page 2789 and 1957, pp. 2574 and 2640, J. Amer. Chem. Soc., Volume 79, page 2549 (1957), J. Japan Oil Chemists Soc., Volume 12, page 653 and J. Org. Chem., Volume 30, page 3524 (1965).

Some of the above-mentioned fluorine-containing surfactants are commercially available as follows: Megafac F produced by DaiNippon Ink Chemical Industry Co, Ltd.; Fluorad FC produced by Minesota Mining and Manufacturing Company; Monflor produced by Imperial Chemical Industry; Zonyls produced by E. I. Du Pont Nemeras and Company; Licowet VPF produced by Falbewereke Hoechst.

The anionic fluorine-containing surfactants and the cationic fluorine-containing surfactants are preferably used in combination in view of image quality improvement.

The total content of the cationic fluorine-containing surfactant and the anionic fluorine-containing surfactant in the ink receiving layer is 0.1 to 1000 mg/m$^2$, preferably 0.5 to 300 mg/m$^2$, and more preferably 1.0 to 150 mg/m$^2$. The cationic fluorine-containing surfactant and anionic fluorine-containing surfactant used may be of two or more kinds, respectively. The betaine fluorine-containing surfactant, nonionic fluorine-containing surfactant and hydrocarbon type surfactant can be used in combination.

The addition amount ratio of the anionic fluorine-containing surfactant to the cationic fluorine-containing surfactant in the invention is preferably 1:10 to 10:1 by mole ratio, and more preferably 3:7 to 7:3 by mole ratio.

It is preferable in view of improved image quality and sharpness that the ink receiving layer in the invention contains a compound represented by the following formula (E):

formula (E)

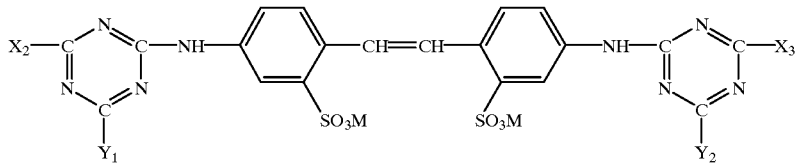

wherein $X_2$, $X_3$, $Y_1$ and $Y_2$ independently represent a hydroxy group, a halogen atom, a substituted or unsubstituted alkyl group, a substituted or unsubstituted aryl group,

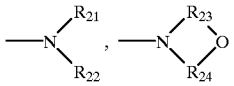

or —$OR_{25}$.

in which $R_{21}$ and $R_{22}$ independently represent a hydrogen atom, a substituted or unsubstituted alkyl group or a substituted or unsubstituted aryl group, $R_{23}$ and $R_{24}$ independently represent a substituted or unsubstituted alkylene group, $R_{25}$ represents a hydrogen atom, a substituted or unsubstituted alkyl group or a substituted or unsubstituted aryl group; and M represents a hydrogen atom or an alkali atom.

The alkyl group represented by $R_{21}$, $R_{22}$ and $R_{25}$ is preferably those having 1 to 6 carbon atoms, and the alkylene group represented by $R_{23}$ and $R_{24}$ is preferably those having 1 to 2 carbon atoms, The substituent which the alkyl or aryl group represented by $R_{21}$, $R_{22}$ and $R_{25}$ or the alkylene group represented by $R_{23}$ and $R_{24}$ may have is preferably a hydroxy, sulfo, sulfoamino or carboxyamino group.

The typical example of the

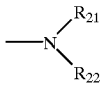

includes an alkylamino group such as methylamino, ethylamino; propylamino, dimethylamino, cyclohexylamino, β-hydroxyethylamino, di(β-hydroxyethyl)amino, β-sulfoethylamino, N-β-sulfoethyl-N-methylamino or N-β-hydroxyethyl-N-methylamino or an arylamino group such as anilino, o-, m-, p-sulfoanilino, o-, m-, p-chloroanilino, o-, m-, p-toluidino, o-, m-, p-carboxyanilino, o-, m-, p-hydroxyanilino, sulfonaphthylamino, o-, m-, p-aminoanilino or o-, m-, p-anidino.

The typical example of the

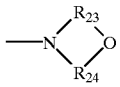

includes a morpholino group, the typical example of the —$OR_{25}$ includes an alkoxy group such as methoxy, ethoxy or methoxyethoxy, and an aryloxy group such as phenoxy or p-sulfophenoxy.

The alkali metal atom represented by M includes sodium, potassium, or lithium, and is preferably sodium or potassium.

Of compounds represented by formula E, the preferable are those in which $X_2$, $X_3$, $Y_1$ and $Y_2$ are simultaneously

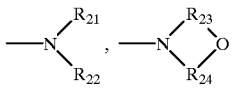

or —$OR_{25}$, and the more preferable are those in which one of $X_2$ and $Y_1$ is —$OR_{25}$, the other

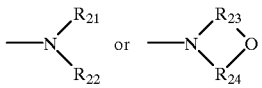

and one of $X_3$ and $Y_2$ is —$OR_{25}$, the other

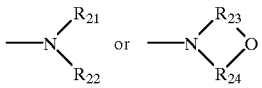

or —$OR_{25}$,

Next, the examples of compounds represented by formula (E) will be shown below, but are not limited thereto.

| | M | $X_2$ | $Y_1$ | $X_3$ | $Y_2$ |
|---|---|---|---|---|---|
| E-1 | Na | 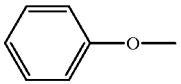 | $—NHC_2H_4OH$ | $—NHC_2H_4OH$ | 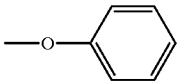 |
| E-2 | Na | $HOC_2H_4NH—$ | $—NHC_2H_4OH$ | $—NHC_2H_4OH$ | $—NHC_2H_4OH$ |
| E-3 | Na | 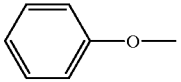 | $—N(C_2H_4OH)_2$ | $—N(C_2H_4OH)_2$ | 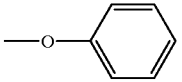 |
| E-4 | Na | $(HOC_2H_4)_2N—$ | $—OCH_3$ | $—OCH_3$ | $—NHC_2H_4SO_3Na$ |
| E-5 | Na | $HOCH_2CH_2NH—$ | $—N(C_2H_4OH)_2$ | $—N(C_2H_4OH)_2$ | $—NHCO_2CH(CH_2OH)OH$ |
| E-6 | Na | $(HOC_2H_4)_2N—$ | $—N(C_2H_4OH)_2$ | $—N(C_2H_4OH)_2$ | $—N(C_2H_4OH)_2$ |
| E-7 | Na | 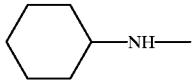 | $—NHC_2H_4OH$ | $—NHC_2H_4OH$ | 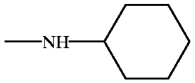 |
| E-8 | Na | 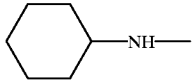 | $—N(C_2H_4OH)_2$ | $—N(C_2H_4OH)_2$ | 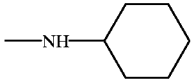 |
| E-9 | Na | $HO—$ | 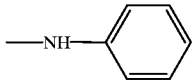 | 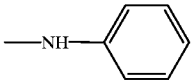 | $—OH$ |
| E-10 | Na | $H_2N—$ | 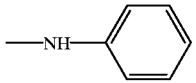 | 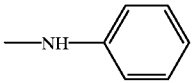 | $—NH_2$ |
| E-11 | Na | $CH_3O—$ | 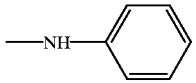 | 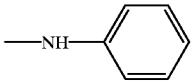 | $—OCH_3$ |

-continued
| | M | $X_2$ | $Y_1$ | $X_3$ | $Y_2$ |
|---|---|---|---|---|---|
| E-12 | Na | $HOC_2H_4NH$— | —NH— 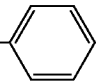 | —NH— 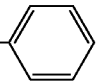 | —$NHC_2H_4OH$ |
| E-13 | Na | $(HOC_2H_4)_2N$— | —NH— 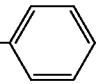 | —NH— 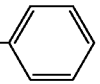 | —$N(C_2H_4OH)_2$ |
| E-14 | Na | $HOC_2H_4NH$— | —NH— 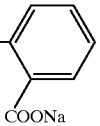 COONa | —NH— 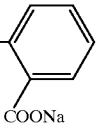 COONa | —$NHC_2H_4OH$ |
| E-15 | Na | 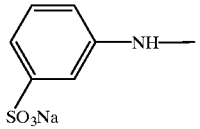 | —$N(C_2H_4OH)_2$ | —$N(C_2H_4OH)_2$ | —NH— 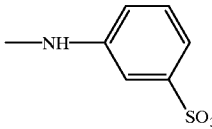 |
| E-16 | Na | $NaO_3S$— 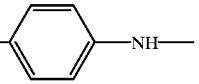 —NH— | —$N(C_2H_4OH)_2$ | —$N(C_2H_4OH)_2$ | —NH— 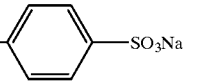 —$SO_3Na$ |
| E-17 | Na | $NaO_3S$— 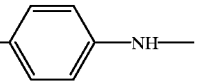 —NH— | —$N(C_2H_4OH)_2$ | —$N(C_2H_4OH)_2$ | —NH— 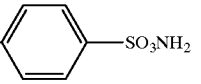 —$SO_3NH_2$ |
| E-18 | Na | $NaO_3S$— 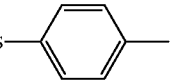 | —$N(C_2H_4OH)_2$ | —$N(C_2H_4OH)_2$ | 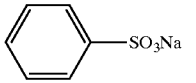 —$SO_3Na$ |
| E-19 | Na | $HOCH_2CH(CH_3)CH_2HN$— | —$OCH_3$ | —$OCH_3$ | —$NHCH_2CH(CH_3)CH_2OH$ |

-continued

| | M | $X_2$ | $Y_1$ | $X_3$ | $Y_2$ |
|---|---|---|---|---|---|
| E-20 | Na | $(HOC_2H_4)_2N$— | —NH— COONa | —NH— COONa | —$N(C_2H_4OH)_2$ |
| E-21 | Na | $HOC_2H_4NH$— | —NH— COONa | —NH— COONa | —$NHC_2H_4OH$ |
| E-22 | Na | $SO_3Na$ —NH— $SO_3Na$ | —$NHC_2H_5$ | —$NHC_2H_5$ | $SO_3Na$ —NH— $SO_3Na$ |
| E-23 | Na | $NaO_3S$ —NH— $SO_3Na$ | —$NHCH_3$ | —$NHCH_3$ | —NH— $SO_3Na$ $SO_3Na$ |
| E-24 | Na | $NaO_3S$ —NH— | —N O | —N O | —NH— $SO_3Na$ |
| E-25 | Na | $HOC_2H_4NH$— | —NH— $CONH_2$ | —NH— $CONH_2$ | —$NHC_2H_4OH$ |
| E-26 | Na | $HOC_2H_4NH$— | —NH— $CO_2NHC_2H_4OH$ | —NH— $CO_2NHC_2H_4OH$ | —$NHC_2H_4OH$ |

-continued

| | M | $X_2$ | $Y_1$ | $X_3$ | $Y_2$ |
|---|---|---|---|---|---|
| E-27 | Na | $(HOC_2H_4)_2N$— | —NH— $C_6H_4$ —$CO_2NHC_2H_4OH$ | —NH— $C_6H_4$ —$CO_2NHC_2H_4OH$ | —$N(C_2H_4OH)_2$ |
| E-28 | Na | $HOC_2H_4NH$— | —NH— $C_6H_4$ —$SO_2NH_2$ | —NH— $C_6H_4$ —$NH_2$ | —$NHC_2H_4OH$ |
| E-29 | Na | $HOC_2H_4NH$— | —NH— $C_6H_4$ —$SO_2NHC_2H_4OH$ | —NH— $C_6H_4$ —$SO_2NHC_2H_4OH$ | —$NHC_2H_4OH$ |
| E-30 | Na | $(HOC_2H_4)_2N$— | —NH— $C_6H_4$ —$SO_2NHC_2H_4OH$ | —NH— $C_6H_4$ —$SO_2NHC_2H_4OH$ | —$N(C_2H_4OH)_2$ |
| E-31 | Na | $C_6H_4$ —N($C_2H_4OH$)— | —NH— $C_6H_5$ | —NH— $C_6H_5$ | —N($C_2H_4OH$)— $C_6H_5$ |
| E-32 | Na | $SO_3Na$ $C_6H_2$ ($HOCH_2$)(NH—)($SO_3Na$) | $C_6H_4$ —OH | $C_6H_4$ —OH | $SO_3Na$ $C_6H_2$ (—NH—)($CH_2OH$)($SO_3Na$) |
| E-33 | Na | $SO_3Na$ $C_6H_2$ ($HOCH_2$)(NH—)($SO_3Na$) | —$NHC_2H_5$ | —$NHC_2H_5$ | $SO_3Na$ $C_6H_2$ (—NH—)($CH_2OH$)($SO_3Na$) |
| E-34 | Na | $CH_3O$— | —$NHCH_2CH(OH)CH_3$ | —$NHCH_2CH(OH)CH_3$ | —$OCH_3$ |

-continued
| | M | $X_3$ | $Y_1$ | $X_3$ | $Y_2$ |
|---|---|---|---|---|---|
| E-35 | Na | 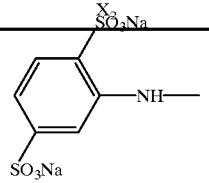 | 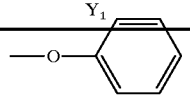 | 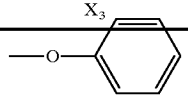 | 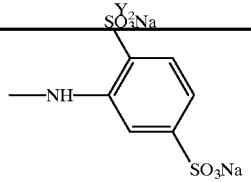 |
| E-36 | Na | 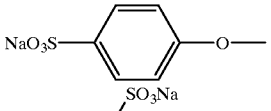 | $—N(C_2H_4OH)_2$ | $—N(C_2H_4OH)_2$ | 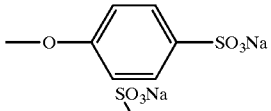 |
| E-37 | Na | 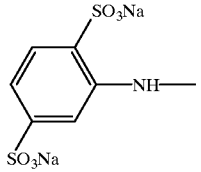 | $—N(C_2H_5)_2$ | $—N(C_2H_5)_2$ | 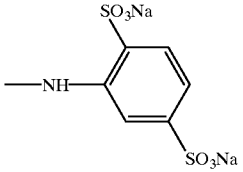 |
| E-38 | Na | 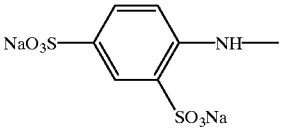 | $—NHCH_3$ | $—NHCH_3$ | 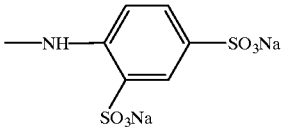 |
| E-39 | Na | $CH_3O—$ | $—NHCH(CH_2OH)CH_3$ | $—NHCH(CH_2OH)CH_3$ | $—OCH_3$ |
| E-40 | Na | $CH_3O—$ | $—N(C_2H_4OH)_2$ | $—N(C_2H_4OH)_2$ | $—OCH_3$ |
| E-41 | Na | $CH_3O—$ | $—NHC_2H_4SO_3Na$ | $—NHC_2H_4SO_3Na$ | $—OCH_3$ |
| E-42 | Na | $CH_3O—$ | $—NHC_2H_4OH$ | $—NHC_2H_4OH$ | $—OCH_3$ |
| E-43 | Na | $CH_3O—$ | 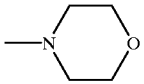 | 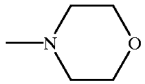 | $—OCH_3$ |
| E-44 | Na | $CH_3O—$ | $—NHC_2H_4SO_3K$ | $—NHC_2H_4SO_3K$ | |
| E-45 | Na | 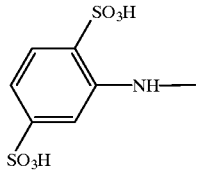 | $—N(C_2H_5)_2$ | $—N(C_2H_5)_2$ | 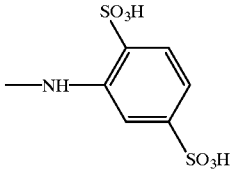 |

The compounds represented by formula (E) can be prepared by a conventional method, for example, a method disclosed on page 8 of "Keikozohakuzai" published in August, 1976, edited by Kaseihin Kogyokyokai. As such a compound, "Unitex" produced by Ciba Geigy Co., Ltd. or "Whitex" produced by Sumitomo Kagaku Co., Ltd. are commercially available. Of the above Exemplified compounds, E-34, E-36 and E-37 are especially preferable.

The content of compounds represented by formula (E) in the ink receiving layer is preferably 0.1 to 10 wt %, and more preferably 0.5 to 5 wt %.

The compound, which can be used together with gelatin, includes a phenol compound, a thiazoline compound, a triazine compound, an imidazoline compound, a guanidine compound and a benzotriazole compound.

The exemplified compound includes ortho-phenyl phenol or its salt (potassium or sodium), 2-octyl-4-isothiazoline, benzisothiazoline-3-one, 2-methyl-4-isothiazoline-3-one, 5-chloro-2-methyl-4-isothiazoline-3-one, 4-thiomethyl-4-ethylamino-6-(1,2-dimethylpropylamino)-s-triazine, hexahydro-1,3,5-tris(2-hydroxyethyl)-s-triazine, 4-(2-nitrobutyl)morpholine, 4-(3-nitrobutyl)morpholine, 2-(4-thiazolyl)benzimidazole, dodecylguanidine hydrochloride and benzotriazole, but is not limited thereto.

In the invention, the gelatin containing layer can be hardened with an appropriate hardener in order to improve water resistance. The example of the hardener includes aldehyde compounds such as formaldehyde and glutaraldehyde, ketone compounds such as diacetyl and chloropentanedion, bis(2-chloroethylurea), 2-hydroxy-4,6-dichloro-1,3,5-triazine, reactive halogen-containing compounds disclosed U.S. Pat. No. 3,288,775, divinylsulfone, reactive olefin-containing compounds disclosed U.S. Pat. No. 3,635,718, N-methylol compounds disclosed U.S. Pat. No. 2,732,316, isocyanates disclosed U.S. Pat. No. 3,103,437, aziridine compounds disclosed U.S. Pat. Nos. 3,017,280 and 2,983,611, carbodiimides disclosed U.S. Pat. No. 3,100,704, epoxy compounds disclosed U.S. Pat. No. 3,091,537, a halogencarboxyaldehyde such as mucochloric acid, a dioxane derivative such as dihydroxy dioxane, and inorganic hardeners such as chromium alum, potash alum and zirconium sulfate. These hardeners can be used singly or in combination. The addition amount of the hardener is preferably 0.01 to 10 g, and more preferably 0.1 to 5 g based on 100 g of gelatin contained in the gelatin containing layer.

It is preferable in the invention that the ink receiving layer does not contain a hardener. The presence of the hardener results in lowering the effect of the invention. The hardening degree varies with time, and therefore, ink absorbance or image resolution also varies due to time used, which is not preferable.

The ink receiving layer in the invention may contain a matting agent such as an organic matting agent.

The organic matting agent includes starch, cellulose ester such as cellulose acetate propionate, cellulose ether such as ethyl cellulose and a synthetic resin. The synthetic resin is a water insoluble or sparingly soluble polymer which includes a polymer of an alkyl(meth)acrylate, an alkoxyalkyl(meth)acrylate, a glycidyl(meth)acrylate, a (meth)acrylamide, a vinyl ester such as vinyl acetate, acrylonitrile, an olefin such as ethylene, or styrene and a copolymer of the above described monomer with other monomers such as acrylic acid, methacrylic acid, α,β-unsaturated dicarboxylic acid, hydroxyalkyl(meth)acrylate, sulfoalkyl(meth)acrylate and styrene sulfonic acid.

Further, an epoxy resin, nylon, polycarbonates, phenol resins, polyvinyl carbazol or polyvinylidene chloride can be used. Besides the above are used inorganic matting agents which are disclosed in British Patent No. 1,055,713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344,554, 3,591,379, 3,754,924 and 3,767,448, Japanese Patent O.P.I. Publication Nos. 49-106821/1974 and 57-14835/1982.

Of these are preferable polymethylmethacrylate, a benzoguanamine-formaldehyde polycondensate (a benzoguanamine resin as represented by the following formula, for example, Eposter produced by Nihon Shokubai Kagakukogyo Co., Ltd., or (Chemical Substance Registry No. 7-31 compound),

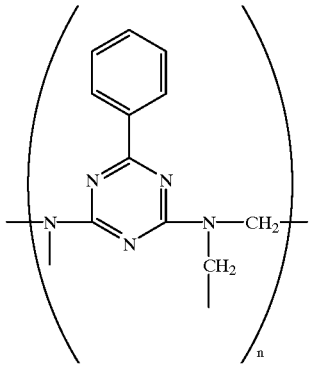

polyolefins (for example, Frobeads LE-1080, CL-2080, HE-5023: produced by Seitetsu Kagaku Co., Ltd., or Chemipar V-100 produced by Mitsuisekiyu Kagakukogyo Co., Ltd.), polystyrene beads (produced by Moritex Co., Ltd.), nylon beads (produced by Moritex Co., Ltd.), AS resin beads (produced by Moritex Co., Ltd.), epoxy resin beads (produced by Moritex Co., Ltd.) or polycarbonate resin beads (produced by Moritex Co., Ltd.).

The ink receiving layer in the invention may further contain, in addition to the above surfactant and binder, various conventional additives such as inorganic pigment, colorants, colored pigment, a fixing agent for ink dyes, a UV absorber, an anti-oxidant, a dispersing agent, an anti-foaming agent, a leveling agent, an antiseptic agent, a brightening agent, a viscosity stabilizing agent and a pH adjusting agent.

As a coating method of an ink receiving layer coating solution, any conventional coating method (for example, a sizepress method, a roll coating method, a blade coating method, an air-knife method, a gate roll coating method, a curtain method, and an extrusion method) can be used.

The drying method after the coating is not limited, but a cold dry method disclosed in on page 3 of Japanese Patent O.P.I. Publication No. 6-64306 in view of a recording sheet with high quality.

The ink receiving layer may be single layered or multi-layered. The example of the multi-layered includes those disclosed in Japanese Patent O.P.I. Publication Nos. 57-89954/1982, 60-224578/1985 and 61-12388/1988. Further, an ink penetrating layer may be provided on the ink receiving layer.

The coating weight of the ink receiving layer in the invention is 3 to 100 g/m$^2$, and preferably 5 to 50 g/m$^2$.

The pH of the ink receiving layer surface in the invention is preferably 3 to 11, and more preferably 4 to 8. The layer surface pH of the ink receiving layer in the invention is obtained by placing about 0.05 ml of pure water on the dry ink receiving layer and contacting a commercially available silver.silver chloride electrode with the water at 25° C.

As a support used in the invention, a transparent or opaque support can be optionally used according to its use.

A conventional support can be used as the transparent support, which includes a film of polyester resins, cellulose acetate resins, acryl resins, polycarbonate resins, polyvinyl chloride resins, polyimide resins, cellophane or celluloid. Of these, a polyester resin film is preferable and a polyethylene terephthalate film is especially preferable in view of stiffness and transparency.

The thickness of the transparent support is preferably 10 to 400 $\mu$m, and more preferably 50 to 300 $\mu$m.

As the opaque support, any conventional one such as resin-covered paper, pigment-containing opaque film or foaming film can be used in the invention, but resin-covered paper or various films are preferable in view of glossiness or smoothness, and resin-covered paper, polyolefin covered paper or polyester film is more preferable in view of touchiness or luxuriousness.

The base paper constituting the resin-covered paper used in the invention is not specifically limited, and any conventional paper can be used, but a smooth paper used as a conventional photographic support is preferable. As pulp constituting the base paper, natural pulp, reproduction pulp or synthetic pulp is used singly or in admixture. These base papers may contain additives such as a sizing agent, a reinforcing agent, a filler, an anti-static agent, a fluorescent brightening agent or a dye which is usually used in paper manufacture. A surface sizing agent, a surface reinforcing agent, a fluorescent brightening agent, an antistatic agent and an anchoring agent may be coated on the surface of the material.

The layer provided on one or each side of the support may contain a matting agent in an amount of 0.005 to 0.1 g/m$^2$ in order to minimize adhesion failure such as blocking.

The matting agent can be defined as discontinuously dispersed particles such as inorganic or organic materials capable of being dispersed in a hydrophilic organic colloid. The inorganic matting agent includes oxides such as silicon oxide, titanium oxide, magnesium oxide and aluminum oxide, alkali earth metal salts such as barium sulfate, calcium carbonate, and magnesium sulfate, light-insensitive silver halide particles such as silver chloride and silver bromide (each of which may contain a small amount of an iodine atom), and glass.

Besides these substances are used inorganic matting agents which are disclosed in West German Patent No. 2,529,321, British Patent Nos. 760 775 and 1,260,772, U.S. Pat. Nos. 1,201,905, 2,192,241, 3,053,662, 3,062,649, 3,257,296, 3,322.555, 3,353,958, 3,370,951, 3,411,907, 3,437,484, 3,523,022, 3,615,554, 3,635,714, 3,769,020, 4,021,245 and 4,029,504.

The organic matting agent includes starch, cellulose ester such as cellulose acetate propionate, cellulose ether such as ethyl cellulose and a synthetic resin. The synthetic resin is a water insoluble or sparingly soluble polymer which includes a polymer of an alkyl(meth)acrylate, an alkoxyalkyl(meth) acrylate, a glycidyl(meth)acrylate, a (meth)acrylamide, a vinyl ester such as vinyl acetate, acrylonitrile, an olefin such as ethylene, or styrene and a copolymer of the above described monomer with other monomers such as acrylic acid, methacrylic acid, $\alpha,\beta$-unsaturated dicarboxylic acid, hydroxyalkyl(meth)acrylate, sulfoalkyl(meth)acrylate and styrene sulfonic acid.

Further, an epoxy resin, nylon, polycarbonates, phenol resins, polyvinyl carbazol or polyvinylidene chloride can be used. Besides the above are used inorganic matting agents which are disclosed in British Patent No. 1,055,713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, Japanese Patent O.P.I. Publication Nos. 49-106821/1974 and 57-14835/1982.

Of these are preferable polymethylmethacrylate, a benzoguanamine-formaldehyde polycondensate (a benzoguanamine resin as represented by the following formula, for example, Eposter produced by Nihon Shokubai Kagakukogyo Co., Ltd., (Chemical Substance Registry No. 7-31 compound),

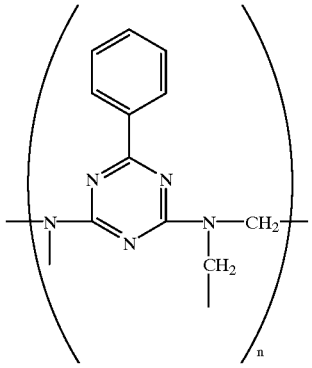

polyolefins (for example, Frobeads LE-1080, CL-2080, HE-5023: produced by Seitetsu Kagaku Co., Ltd., or Chemipar V-100 produced by Mitsuisekiyu Kagakukogyo Co., Ltd.), polystyrene beads (produced by Moritex Co., Ltd.), nylon beads (produced by Moritex Co., Ltd.), AS resin beads (produced by Moritex Co., Ltd.), epoxy resin beads (produced by Moritex Co., Ltd.) or polycarbonate resin beads (produced by Moritex Co., Ltd.).

These matting agents may be used in combination.

The thickness of the base paper is not specifically limited. A base paper having a smooth surface is preferable, which is obtained by applying pressure to or calendering, paper, during or after papering. The weight of the base paper is preferably 30 to 250 g/m$^2$.

The polyolefin-covered paper, which is the support preferably used in the invention, is manufactured by a so-called extrusion method casting a thermally fused resin (a fused polyolefin) on the moving base paper, whereby both surfaces of the paper are covered with the resin. When the paper is covered with a resin capable of being hardened with electron beam irradiation, the resin is coated with a conventional coater such as a gravure coater or a blade coater and then is irradiated with electron beam to harden the coated resin. Before the paper is coated with a resin, the surface of the paper is preferably subjected to activation treatment such as corona discharge treatment or flame treatment. The surface of the support on the ink receiving layer side is glossy or matted depending upon its usage, and glossy surface is preferable. The back side of a support is not necessarily covered with a resin, but is preferably covered with a resin in view of prevention of curling. The back surface of a support is ordinarily non-glossy, but the back surface or both surfaces of the support are optionally subjected to activation treatment such as corona discharge treatment or flame treatment. The thickness of a covered resin is not specifically limited, but is ordinarily 5 to 50 $\mu$m.

As a polyolefin resin which is coated on the base paper preferably used, a polyolefin resin or a resin capable of being hardened with an electron beam can be used. The polyolefin resin includes an olefin homopolymer such as a low density polyethylene, a high density polyethylene, polypropylene or polypentene, an olefin copolymer such as ethylene-propylene copolymer or their mixture, each having various densities or melt viscosity indexes (melt index). These resins can be used singly or in combination.

The resin for the polyolefin resin-covered paper preferably contains various additives, for example, white pigment such as titanium oxide, zinc oxide, talc or calcium carbonate, a fatty acid amide such as stearic acid amide or arachidic acid amide, a fatty acid metal salt such as zinc stearate, calcium stearate, aluminum stearate or magnesium stearate, an anti-oxidant such as Irganox 1010 or Irganox 1076, blue pigment or dyes such as cobalt blue, ultramarine, or phthalocyanine blue, magenta pigment or dyes such as cobalt violet, fast violet or manganese violet, a brightening agent and a UV absorber. These additives can be suitably used in combination.

The paper thickness of the polyolefin resin-covered paper is not specifically limited, but is preferably 50 to 300 $\mu$m, and more preferably 80 to 200 $\mu$m, in view of transportability or the effect of the invention.

The water based ink used for ink jet recording in the invention is a recording liquid comprising the following colorants, solvents and other additives. The colorant includes a direct dye, an acid dye, a basic die, a reactive dye and food dyes.

The solvent for water based ink includes alkyl alcohols having 1 to 4 carbon atoms such as methyl alcohol, ethyl alcohol, isopropyl alcohol, butyl alcohol, sec-butyl alcohol, tert-butyl alcohol and iso-butyl alcohol, amides such as dimethylformamide and dimethylacetoamide, ketones or ketonealcohols such as acetone and diacetone alcohol, ethers such as tetrahydrofurane and dioxane, polyalkylene glycols such as polyethylene glycol and polypropylene glycol, alkylene glycols having 2 to 6 carbon atoms such as ethylene glycol, propylene glycol, butylene glycol, triethylene glycol, 1,3,6-hexane triol, hexylene glycol, thiodiglycol and diethylene glycol, polyhydric alcohol lower alkyl ethers such as glycerin, ethylene glycol methylether, diethylene glycol methyl(or ethyl)ether and triethylene glycol monomethylether, pyrrolidinones such as 2H-pyrrolidinone, and pyrrolidones such as 1-methyl-2-pyrrolidone and 2-pyrrolidone. Of these water soluble solvents, a polyhydric alcohol such as diethylene polyhydric alcohol lower alkyl ethers such as triethylene glycol monomethylether and triethylene glycol monoethylether, and pyrrolidones are preferable.

In the invention, the solvent for ink is preferably a mixture solvent of water and the above described organic solvent in view of prevention of ink head nozzle clogging. The mixture ratio of water to the organic solvent is preferably 1:9 to 9:1 by weight, and more preferably 4:6 to 9:1 by weight.

The other additives, which are incorporated in the ink, include a pH adjusting agent, a metal chelating agent, an anti-fungal, a viscosity adjusting agent, a surface tension adjusting agent, a wetting agent, a brightening agent, a matting agent, a surfactant and an anti-rust agent.

The back coat layer in the invention is a layer provided on the surface of the support opposite the ink receiving layer, and may be single layered or multi-layered. The back coat layer may also have ink receptivity. provided on both surfaces of the support in order to minimize curling.

The same material as in the ink receiving layer can be used in the back coat layer.

In the invention, the ink receiving layer can provide ink absorbance or improved image quality, and the recording sheet comprising the ink receiving layer and the back coat layer, in which the gelatin content ratio of the ink receiving layer to the back coat layer is 1.1 to 1.9, and preferably 1.2 to 1.5, can stabilize its physical properties, improve transportability and minimize back-side ink offset.

The back coat layer, which does not have ink receptivity, preferably contains a commercial hardener or a matting agent.

The back coat layer may contain other additives such as a pH adjusting agent, a metal chelating agent, an anti-fungal, a viscosity adjusting agent, a surface tension adjusting agent, a wetting agent or an anti-rust agent.

An object of the invention is also to attain the following object.

(1) Another object of the present invention is to provide a recording sheet for ink-jet recording with excellent transportability under low or high humidity condition, with excellent ink absorption, and without deterioration of printing capability under low or high humidity condition, while giving high quality images with excellent gradation and without deterioration of glossiness.

(2) Still another object of the present invention is to provide a recording sheet for ink-jet recording with excellent ink absorption and ink fixibility under low temperature and high humidity conditions, and with excellent glossiness and high transparency.

The above object (1) can be solved by the following constitution (hereinafter referred to as Constitution 1).

1. A recording sheet for ink-jet recording comprising a support, and provided thereon, an ink receiving layer, wherein the support has a Taber stiffness of 0.7 to 20 g.cm and the ink receiving layer contains at least one polymer latex.

2. The recording sheet for ink-jet recording of 1 above, wherein the ink receiving layer further contains at least one water soluble polymer and gelatin.

3. The recording sheet for ink-jet recording of 2 above, wherein the polymer latex content A ($g/m^2$) of the ink receiving layer and the gelatin content B ($g/m^2$) of the ink receiving layer satisfy the following inequality:

$$0.1<A/B<2.0$$

4. The recording sheet for ink-jet recording of 1, 2 or 3 above, wherein the support is a resin-covered paper in which both surfaces of paper is covered with a resin layer.
5. The recording sheet for ink-jet recording of 1, 2, 3 or 4 above, wherein the ink receiving layer consists of plural layers.
6. The recording sheet for ink-jet recording of 1, 2, 3, 4 or 5 above, wherein the ink receiving layer consists of plural layers and an outermost layer of the plural layers has a polymer latex content of 40% or less by weight.
7. The recording sheet for ink-jet recording of 1, 2, 3, 4, 5 or 6 above, comprising a support, and an ink receiving layer provided thereon and a backing layer provided on the surface of the support opposite the ink receiving layer, wherein the backing layer contains at least one polymer latex.

The above object (2) can be solved by the following constitution (hereinafter referred to as Constitution 2).

1. A recording sheet for ink-jet recording comprising a support, and provided thereon, an ink receiving layer containing gelatin and a water soluble polymer, wherein the ink receiving layer consists of layers in quantity of n in which n represents an integer of 2 or more, and the following inequality is satisfied:

$$\kappa\alpha_1 \geqq \kappa\alpha_2 \ldots \kappa\alpha_n$$

wherein $\kappa\alpha_1$ ($m/sec^{1/2}$) represents an ink absorption coefficient of an outermost ink receiving layer and $\kappa\alpha_2$ ($m/sec^{1/2}$), . . . $\kappa\alpha_n$ ($m/sec^{1/2}$) represent ink absorption coefficients of ink receiving layers other than the outermost ink receiving layer.

2. The recording sheet for ink-jet recording of 1 above, wherein the ink receiving layer consists of three layers or more.
3. The recording sheet for ink-jet recording of 1 or 2 above, wherein the water soluble polymer is selected from the group consisting of polyalkylene oxides, polyvinyl pyrrolidones, polyvinyl alcohols, hydroxypropyl celluloses and carboxymethyl celluloses.
4. The recording sheet for ink-jet recording of 3 above, wherein the water soluble polymer is polyalkylene oxides or polyvinyl pyrrolidones.
5. The recording sheet for ink-jet recording of 1, 2, 3 or 4 above, wherein the content ratio by weight of the water, soluble polymer content to the gelatin content is 0.1 to 3.0.
6. The recording sheet for ink-jet recording of 1, 2, 3, 4 or 5 above, wherein the ink receiving layer further contains at least one polymer latex.
7. The recording sheet for ink-jet recording of 1, 2, 3, 4, 5 or 6 above, wherein the ink receiving layer further contains at least one polyurethane.

In Constitutions 1 and 2, the ink receiving layer preferably contains at least one water soluble polymer, at least one polymer latex and gelatin, as described above. In Constitution 1, gelatin or a water soluble polymer in combination with a polymer latex can be used in the ink receiving layer in view of improved ink absorption, and a combined use of a water soluble polymer, gelatin and at least one polymer latex is more preferable in view of high ink absorption, glossiness and anti-banding property.

In Constitution 2, it is preferable that the ink receiving layer further contains at least one polymer latex and/or at least one polyurethane, whereby deterioration of glossiness on printed images, which is likely to occur when the images are quickly dried after being printed under high humidity condition, is minimized.

In Constitutions 1 and 2 are used the materials, their content and constitution as described above, as long as not otherwise specified.

In Constitution 1, the ink receiving layer preferably contains a polyurethane in that gradation can be controlled.

The polyurethane used in Constitution 1 or 2 includes an addition polymerization compound of a polyisocyanate compound with a polyol having two or more hydroxy groups, and preferably is a nonionic urethane polymer or a urethane polymer having an anionic group in the main or side chain.

The polyurethane used in the invention is preferably in the form of an aqueous dispersion in which an organic solvent is not used in coating in view of environmental concerns. There are two type aqueous polyurethane dispersions, and one is a forced emulsifying dispersion in which polyurethane is emulsified by use of a surfactant and the other a self-emulsifying dispersion in which a hydrophilic group is incorporated in the polyurethane skeleton so that the polyurethane is emulsified. Both dispersions can be used in the present invention and the self-emulsifying dispersion is preferable in view of glossiness and transparency of a recording sheet for ink jet recording.

Of polyisocyanates for forming a polyurethane, the compound having two isocyanate groups includes 1,2-diisocyanateethane, 1,3-diisocyanatepropane, tetramethylenediisocyanate, pentamethylenediisocyanate, hexamethylenediisocyanate, nonamethylenediisocyanate, decamethylenediisocyanate, ),ω,ω'-dipropyletherdiisocyanate, cyclohexanone-1,4-diisocyanate, dicyclohexylmethane-4,4'-diisocyanate, hexahydrodiphenyl-4,4,'-diisocyanate, hexadihydrodiphenylether-4,4'-diisocyanate, phenylene-1,4'-diisocyanate, toluylene-2,6-diisocyanate, toluylene-2,4-diisocyanate, 1-methoxybenzene-2,4-diisocyanate, 1-chlorophenylenediisocyanate, tetrachlorophenylenediisocyanate, metaxylenediisocyanate, paraxylenediisocyanate, diphenylmethane-4,4,'-diisocyanate, diphenylsufide-4,4'-diisocyanate, diphenylsulfone-4,4,'-diisocyanate, diphenylether-4,4,'-diisocyanate, diphenylether-3,4'-diisocyanate, diphenylkeyone-4,4'-diisocyanate, naphthalene-1,4-diisocyanate, naphthalene-1,5-diisocyanate, 2,4'-biphenyldiisocyanate, 4,4'-biphenyldiisocyanate, 3,3'-dimethoxy-4,4,'-biphenyldiisocyanate, anthraquinone-2,6-diisocyanate, triphenylmethane-4,4'-diisocyanate and azobenzene-4,4,'-diisocyanate.

The compound having three isocyanate groups includes a compound represented by the following formula (I), (II), (III), or (IV):

(I)

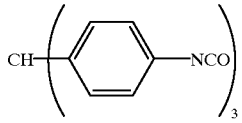

(II)

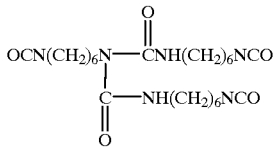

(III)

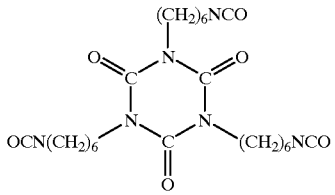

(IV)

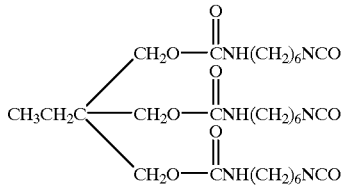

The polyol having two or more hydroxy groups includes a diol such as ethylene glycol, diethylene glycol, triethylene glycol or propylene glycol, a triol such as trimethylolethane, trimethylolpropane, hexanetriol or glycerin, a hexaol such as sorbitol, polyesterpolyol, polyetherpolyol and polyesterpolyetherpolyol. The polyesterpolyol is a compound prepared from a polybasic acid and a polyhydric compound and is preferably a compound having a hydroxy group in the end. As the polybasic acid, a saturated fatty acid such as oxalic acid, succinic acid, adipic acid or pimellic acid, an unsaturated fatty acid such as maleic acid or fumalic acid, an aromatic acid such as phthalic acid or isophthalic acid or their anhydride is used singly or in combination and as the polyhydric compound, a diol such as ethylene glycol, diethylene glycol, triethylene glycol or propylene glycol, a triol such as trimethylolpropane, trimethylolethane, hexanetriol or glycerin, a hexaol such as sorbitol, polyesterpolyol is used singly or in combination.

The polyetherpolyol is a compound having two or more hydroxy groups and an ether bond in the molecule. The polyetherpolyol includes a homopolymer or copolymer of ethylene oxide (EO) or propylene oxide (PO), a triol such as glycerin, trimethylolpropane or hexanetriol, a hexaol such as sorbitol, a polyol prepared by addition of EO or PO to amines such as ethylenediamine, benzensulfamide, 2-aminoethanolamine, N-methyldiethanolamine, diethylenetriamine and an amine having an aromatic group and their derivative. The polyetherpolyol can be used singly or in combination. The polyesterpolyetherpolyol is a polycondensate of the polybasic acid with the polyetherpolyol compound, the polycondensate having a hydroxy group in the end.

The other polyols include castor oil, tall oil or their derivative, acrylpolyol and urethanepolyol. These polyols can be used singly or in combination.

The polyurethane consisting of the above described components can be prepared by conventional methods. The polyurethane used in the invention is preferably a self-emulsifying dispersion in which a hydrophilic group is incorporated in the polyurethane skeleton and emulsified. The typical example of the hydrophilic group includes an anionic group such as a carboxyl group, a sulfonic acid group, a sulfate ester group or a phosphate ester group, a cationic group or cation precursor group such as a primary amino group, a secondary amino group or a quaternary ammonium group or a nonionic group such as a hydroxy group, an ether group or an amido group.

The self-emulsifying anionic polyurethane dispersion can be prepared by the methods disclosed in Japanese Patent Publication Nos. 43-9076 and 42-24194, Japanese Patent O.P.I. Publication Nos. 51-24658, 51-22756, 50-112490, 51-60294, 49-128997, 50-51597, 51-86593, 51-77695 and 49-99154, Japanese Patent Publication Nos. 49-28653, 46-15517, 46-18501, 45-26312, 43-6480, 42-19278, 42-24192 and 42-24194, and Japanese Patent O.P.I. Publication No. 51-36294.

The polyurethane content of the ink receiving layer is preferably 1 to 70 weight %, more preferably 3 to 50 weight % and still more preferably 5 to 30 weight %.

The ink receiving layer of Constitution 1 may be a single layer or plural layers, but, in order to obtain higher ink absorption, minimize bleeding out under high humidity condition and improve gradation, the ink receiving layer is preferably plural layers wherein the polymer latex content of an outermost layer is 40% by weight or less.

In Constitution 2, the ink receiving layer consists of layers in quantity of n in which n represents an integer of 2 or more, and the following inequality is satisfied:

$$\kappa\alpha_1 \geqq \kappa\alpha_2 \ldots \kappa\alpha_n$$

wherein $\kappa\alpha_1$ (m/sec$^{1/2}$) represents an ink absorption coefficient of an outermost ink absorption layer and $\kappa\alpha_2$ (m/sec$^{1/2}$) . . . $\kappa\alpha_n$ (m/sec$^{1/2}$) represent ink absorption coefficients of ink receiving layers other than the outermost ink absorption layer.

The recording sheet for ink-jet recording comprising the above ink receiving layer provides excellent ink absorption in printing under low temperature and high humidity conditions and minimizes blurring or color contamination which occurs due to ink movement in the ink receiving layer.

As the integer of n increases, the n-th layer is closer to the support. The ink absorption coefficient is obtained according to a pristo method as defined in Nihon Kamipulp Gijutukyokai. (This method is detailed in J'TAPPI No. 51.) The ink absorption coefficient $\kappa\alpha$ is obtained from the slope of a line formed by plotting the ink permeation depth (ml/m$^2$) against ½ power of the ink contacting time (sec.$^{1/2}$) to the ink receiving layer.

In the invention, the above ink absorption coefficient can be controlled according to the kinds of gelatin or water soluble polymers used or their content.

The layers in quantity of n herein referred to mean layers in quantity of n which are different from each other in components and/or composition constituting the layers.

In the invention, the ink receiving layer preferably consists of three layers or more, whereby the present invention is markedly effected.

The support used in Constitution 1 is a support having a Taber stiffness according to JIS P-8125 of 0.7 to 20 g.cm and preferably 1 to 12 g.cm. The support may be transparent or non-transparent.

The recording sheet having a support with a Taber stiffness according to JIS P-8125 of less than 0.7 g.cm is deformed due to its poor stiffness by applying only a small force, results in transporting failure, which is not overcome even if the stiffness is improved by an ink receiving layer. The recording sheet having a support with a Taber stiffness according to JIS P-8125 of not less than 20 g.cm does not easily bend due to its high stiffness. Such a sheet results in transporting failure when used in a printer using a curved transporting method, and also causes trouble of contacting the head during printing or banding due to transporting failure when used in a printer using another transporting method.

The support used in Constitution 1 includes those described above, provided that it has the above described hardness.

EXAMPLES

The invention will be detailed in the following examples and comparative examples, but the invention is not limited thereto. In the examples, all "parts" are parts by weight, unless otherwise specified.

EXAMPLE 1

(1) Preparation of support

The resin composition consisting of 70 parts of low density polyethylene and 20 parts of high density polyethylene was coated on one side of paper base having a basis weight of 100 g to be 20 g/m$^2$, and the resin composition consisting of 50 parts of low density polyethylene and 50 parts of high density polyethylene was coated on the other side of the paper base to be 20 g/m$^2$. Thus, a support RC-1 (100 $\mu$m) was prepared.

(2) Preparation of ink receiving layer and recording sheet sample

The coating solution containing the following ink receiving layer composition was prepared and coated on the support to give a dry thickness of the ink receiving layer of 8.0 g/m$^2$. Thus, samples 1-1 through 1-11 were obtained.

| <Ink receiving layer composition> | |
|---|---|
| Gelatin (Type KV-3000 produced by Konica Corporation) | as shown in Table 1 |
| Polyvinyl alcohol | as shown in Table 1 |
| PVP-K-90 (produced by BASF Co., Ltd.) | as shown in Table 1 |
| Puluronic F-108 (produced by Asahi Denka Co., Ltd.) | as shown in Table 1 |
| PEG 150000 (Alcox R150 produced by Meisei Kagaku Co., Ltd.) | as shown in Table 1 |
| Exemplified Compound (1) | as shown in Table 1 |
| Exemplified Compound (3) | as shown in Table 1 |
| Exemplified Compound (6) | as shown in Table 1 |

-continued

| <Ink receiving layer composition> | |
|---|---|
| Surfactant FA-3 | 0.2% by weight of the layer coating weight |
| Surfactant FK-8 | 0.2% by weight of the layer coating weight |
| Surfactant F | 1.0% by weight of the layer coating weight |

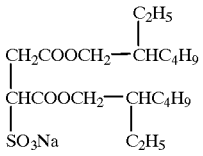

Using an ink jet printer MJ-5000C (produced by Seiko Epson) and an exclusive ink, an image was recorded on the samples obtained above, and evaluated according to the following methods.

(Evaluation of Glossiness)

The black image K was observed and its glossiness was evaluated according to the following evaluation criteria:

Evaluation Criteria

A: No problem

B: Glossiness is slightly inadequate, but no practical problems.

C: Glossiness is apparently lowered.

D: Glossiness is too low to be of practical use.

(Evaluation of Banding)

An image was recorded at 10° C. and 70% RH as above, and the black image K was evaluated for banding according to the following evaluation criteria:

Evaluation Criteria

A: No banding, and a uniform image was obtained.

B: Slight banding, but practically no practical problems.

C: Banding is observed at constant intervals.

D: Banding is observed over entire image.

<Ink Absorption>

<Evaluation of Ink Absorptivity>

Three minutes and 10 minutes after B, G, R and K images were printed on the samples, commercially available wood free paper was brought into contact with the B, G, R and K images (at 1 kg/m$^2$ pressure), and then, the transfer degree of the ink image onto the wood free paper was evaluated according to the following evaluation criteria:

A: The contact carried out 3 minutes after printing results in slight ink transfer of K images, but the contact carried out 10 minutes after printing results in no ink transfer observed and therefore, there is no practical problem.

B: The contact carried out 3 minutes after printing results in slight ink transfer of the B, G, R and K images, but the contact carried out 10 minutes after printing results in no ink transfer and therefore, there is no practical problem.

C: The contact carried out 3 minutes after printing results in ink transfer at some of B, G, R and K images, and therefore, there is a problem.

The results are shown in Table 1.

TABLE 1

| Sample No. | | 1-1 | 1-2 | 1-3 | 1-4 | 1-5 | 1-6 | 1-7 | 1-8 | 1-9 | 1-10 | 1-11 |
|---|---|---|---|---|---|---|---|---|---|---|---|---|
| Gelatin | ($g/m^2$) | 7.5 | 7.5 | 7.5 | 7.5 | 7.5 | 5.0 | 5.0 | 5.0 | 5.0 | 5.0 | 5.0 |
| Polyvinyl alcohol (PVA) | ($g/m^2$) | 7.5 | — | — | — | — | 5.0 | — | — | — | — | — |
| FVP K-90 | ($g/m^2$) | — | 7.5 | — | — | — | — | 5.0 | — | — | — | — |
| Puluronic F108 | ($g/m^2$) | — | — | 7.5 | — | — | — | — | 5.0 | — | — | — |
| PDG 150000 (Alcox R-150) | ($g/m^2$) | — | — | — | 7.5 | — | — | — | — | 5.0 | 5.0 | 5.0 |
| Exemplified compound (1) | ($g/m^2$) | — | — | — | — | 7.5 | 5.0 | 5.0 | 5.0 | 5.0 | — | — |
| Exemplified compound (3) | ($g/m^2$) | — | — | — | — | — | — | — | — | — | 5.0 | — |
| Exemplified compound (6) | ($g/m^2$) | — | — | — | — | — | — | — | — | — | — | 5.0 |
| Glossiness | | D | D | D | C | C | B | B | B | A | A | A |
| Banding | | D | C | C | C | C | B | B | B | A | A | A |
| Ink absorption | | C | C | C | B | C | B | B | A | A | A | A |
| Remarks | Comp. | Comp. | Comp. | Comp. | Comp. | Inv. | Inv. | Inv. | Inv. | Inv. | Inv. | Inv. |

PEG 150000: Polyethylene glycol having an average molecular weight of 150,000

As is apparent from Table 1, the inventive samples containing the polymer latex and water soluble polymer provides high glossiness and high ink absorption under low temperature and high humidity conditions. Further, the polyethylene glycol as a water soluble polymer provides preferable results.

EXAMPLE 2

Sample Nos 2-1 through 2-15 were prepared in the same manner as in Example 1, except that the content of the gelatin, PVP, PEG 150000 and polymer latex were changed as shown in Table 2 and the ratio A/B was set as shown in Table 2, and were evaluated in the same manner as in Example 1.

The results are shown in Table 2.

TABLE 2

| Sample No. | 2-1 | 2-2 | 2-3 | 2-4 | 2-5 | 2-6 | 2-7 | 2-8 | 2-9 | 2-10 | 2-11 | 2-12 | 2-13 | 2-14 | 2-15 |
|---|---|---|---|---|---|---|---|---|---|---|---|---|---|---|---|
| Gelatin ($g/m^2$) | 7.5 | 7.5 | 7.5 | 7.5 | 7.0 | 6.5 | 5.0 | 4.5 | 3.5 | 7.5 | 7.0 | 6.5 | 5.0 | 4.5 | 3.5 |
| PVP K-90 ($g/m^2$) | 7.5 | — | — | — | — | — | — | — | — | 7.1 | 7.0 | 6.5 | 5.0 | 4.5 | 3.5 |
| PEG 150000 (Alcox R-150) ($g/m^2$) | — | 7.5 | — | 7.1 | 7.0 | 6.5 | 5.0 | 4.5 | 3.5 | — | — | — | — | — | — |
| Exemplified compound (1) ($g/m^2$) | — | — | 7.5 | 0.38 | 1.05 | 2.0 | 5.0 | 6.0 | 8.0 | 0.38 | 1.05 | 2.0 | 5.0 | 6.0 | 8.0 |
| A/B | — | — | — | 0.05 | 0.15 | 0.31 | 1.0 | 1.33 | 2.3 | 0.05 | 0.15 | 0.31 | 1.0 | 1.33 | 2.3 |
| Glossiness | D | D | D | B | B | A | A | B | B | B | B | B | B | B | B |
| Banding | C | C | C | B | A | A | A | A | B | B | B | B | B | B | B |
| Ink absorption | C | B | C | B | A | A | A | A | B | B | B | B | B | B | B |
| Remarks | Comp. | Comp. | Comp. | Inv. | Inv. | Inv. | Inv. | Inv. | Inv. | Inv. | Inv. | Inv. | Inv. | Inv. | Inv. |

As is apparent from Table 2, the inventive samples having an ink receiving layer with a A/B ratio of 0.15 to 1.33 provide preferable results.

EXAMPLE 3

Sample Nos 3-1 through 3-10 were prepared in the same manner as in Example 1, except that the content ratio of gelatin, PEG and polymer latex, Exemplified compound (1) was 33:33:33, the coating amount of the ink receiving layer was 15 $g/m^2$ and the average molecular weight of the PEG used was changed as shown in Table 3, and were evaluated in the same manner as in Example 1.

The results are shown in Table 3.

TABLE 3

| Sample No. | Average molecular weight of PEG used | Glossiness | Banding | Ink absorption | Remarks |
|---|---|---|---|---|---|
| 3-1 | — | C | C | C | Comp. |
| 3-2 | 60000 | C | C | B | Inv. |
| 3-3 | 10000 | B | B | B | Inv. |
| 3-4 | 20000 | B | B | B | Inv. |
| 3-5 | 50000 | A | A | A | Inv. |
| 3-6 | 100000 | A | A | A | Inv. |
| 3-7 | 150000 | A | A | A | Inv. |
| 3-8 | 300000 | A | A | A | Inv. |

TABLE 3-continued

| Sample No. | Average molecular weight of PEG used | Glossiness | Banding | Ink absorption | Remarks |
|---|---|---|---|---|---|
| 3-9 | 500000 | B | A | B | Inv. |
| 3-10 | 700000 | B | B | B | Inv. |

As is apparent from Table 3, the inventive samples employing polyethylene glycol having an average molecular weight of 10,000 to 500,000 provide preferable results.

EXAMPLE 4

The first coating solution containing the following first ink receiving layer composition and the second coating solution containing the following second ink receiving layer composition were prepared and coated on the support. The first coating solution was coated on the support to obtain a first layer and then the second coating solution was coated on the first layer to obtain a second layer. Thus, samples 4-1 through 4-9 were obtained.

| <First ink receiving layer composition> | |
|---|---|
| Gelatin (Type KV-3000 produced by Konica Corporation) | as shown in Table 4 |
| PVP-K-90 (produced by BASF Co., Ltd.) | as shown in Table 4 |
| PEG 150000 (Arcox R150 produced by Meisei Kagaku Co., Ltd.) | as shown in Table 4 |
| Exemplified Compound (1) | as shown in Table 4 |
| Organic fine particle matting agent | 0.26 g/m$^2$ |
| Surfactant FA-3 | 0.2% by weight of the first layer coating weight |
| Surfactant FK-8 | 0.2% by weight of the first layer coating weight |
| Surfactant F | 1.0% by weight of the first layer coating weight |
| <Second coating solution for ink receiving layer> | |
| Gelatin (Type KV-3000 produced by Konica Corporation) | as shown in Table 4 |

-continued

| | |
|---|---|
| PVP-K-90 (produced by BASF Co., Ltd.) | as shown in Table 4 |
| PBG 150000 (Arcox R150 produced by Meisei Kagaku Co., Ltd.) | as shown in Table 4 |
| Exemplified Compound (1) | as shown in Table 4 |
| Fluorescent brightening agent E-34 | 0.29 g/m$^2$ |

The samples obtained above were evaluated in the same manner as in Example 1, and in addition, evaluated for ink blurring according to the following methods.

(Evaluation on Ink Bleedig)

A character was printed with black ink on the red, green and blue images using the above obtained samples, and the resulting samples were stored at 35° C. and 80% RH for 2 days, and ink bleeding was evaluated according to the following evaluation criteria:

Evaluation Criteria

A: No ink bleeding observed at each color portion, and the printed characters are legible.

B: Slight ink bleeding occurs in complex types of printed characters, but the printed characters are still legible.

C: The printed characters thicken and ink bleeding occurs, but the printed characters are legible.

D: Marked ink bleeding occurs, and the printed characters are illegible.

TABLE 4

| | Second 2 and | Component content ratio (wt %) at each layer | | | | Component content (g/m$^2$) at each layer | | | | |
|---|---|---|---|---|---|---|---|---|---|---|
| Sample No. | first 1 layers | Gelatin | PEG 150000 | PVP K-90 | Exemplified compound (1) | Gelatin | PEG 150000 | PVP K-90 | Exemplified compound (1) | Total coating amount |
| 4-1 | 2 | 50 | — | 50 | — | 7.0 | — | 7.0 | — | 14.0 |
| | 1 | — | — | — | — | — | — | — | — | — |
| | Sum | 50 | — | 50 | — | 7.0 | — | 7.0 | — | 14.0 |
| 4-2 | 2 | 33.3 | — | 33.3 | 33.4 | 2.33 | — | 2.33 | 2.34 | 7.0 |
| | 1 | 33.3 | 33.3 | — | 33.4 | 2.33 | 2.33 | — | 2.34 | 7.0 |
| | Sum | 33.3 | 16.6 | 16.6 | 33.4 | 4.66 | 2.33 | 2.33 | 4.68 | 14.0 |
| 4-3 | 2 | 33.3 | 33.3 | — | 33.4 | 2.33 | — | 2.33 | 2.34 | 7.0 |
| | 1 | 46 | 20 | — | 34 | 3.22 | — | 1.40 | 2.38 | 7.0 |
| | Sum | 39.6 | 26.6 | — | 33.7 | 5.55 | — | 3.73 | 4.72 | 14.0 |
| 4-4 | 2 | 33.3 | 33.3 | — | 33.4 | 2.33 | 2.33 | — | 2.34 | 7.0 |
| | 1 | 33.3 | 20 | 13 | 33.7 | 2.33 | 1.40 | 0.91 | 2.36 | 7.0 |
| | Sum | 33.3 | 26.6 | 6.5 | 33.6 | 4.66 | 3.73 | 0.91 | 4.70 | 14.0 |
| 4-5 | 2 | 33.3 | 20 | 13 | 33.7 | 2.33 | 1.40 | 0.91 | 2.36 | 7.0 |
| | 1 | 33.3 | 13 | 20 | 33.7 | 2.33 | 0.91 | 1.40 | 2.36 | 7.0 |
| | Sum | 33.3 | 16.5 | 16.5 | 33.7 | 4.66 | 2.31 | 2.31 | 4.72 | 14.0 |
| 4-6 | 2 | 50 | 50 | — | — | 3.5 | 3.5 | — | — | 7.0 |
| | 1 | 33.3 | 33.3 | — | 33.4 | 2.33 | 2.33 | — | 2.34 | 7.0 |
| | Sum | 41.6 | 41.6 | — | 16.7 | 5.83 | 5.83 | — | 2.34 | 14.0 |
| 4-7 | 2 | 50 | 50 | — | — | 3.5 | 3.5 | — | — | 7.0 |
| | 1 | 33.3 | 20 | 13 | 33.4 | 2.33 | 1.40 | 0.91 | 2.36 | 7.0 |
| | Sum | 41.6 | 35 | 6.5 | 16.9 | 5.83 | 4.90 | 0.91 | 2.36 | 14.0 |
| 4-8 | 2 | 50 | 50 | — | — | 3.5 | 3.5 | — | — | 7.0 |
| | 1 | 33.3 | — | 33.3 | 33.4 | 2.33 | — | 2.33 | 2.34 | 7.0 |
| | Sum | 41.6 | 25 | 16.6 | 16.7 | 5.83 | 3.5 | 2.33 | 2.34 | 14.0 |
| 4-9 | 2 | 50 | 30 | 20 | — | 2.5 | 2.10 | 1.40 | — | 7.0 |
| | 1 | 33.3 | — | 33.3 | 33.4 | 2.33 | — | 2.33 | 2.34 | 7.0 |
| | Sum | 41.6 | 15 | 26.6 | 16.7 | 5.83 | 2.10 | 3.73 | 2.34 | 14.0 |

The results are shown in Table 5.

TABLE 5

| Sample No. | Glossiness | Banding | Ink absorption | Ink blurring | Remarks |
|---|---|---|---|---|---|
| 4-1 | D | C | D | C | Comp. |
| 4-2 | B | B | B | B | Inv. |
| 4-3 | A | A | B | A | Inv. |
| 4-4 | A | A | B | A | Inv. |
| 4-5 | A | A | B | A | Inv. |
| 4-6 | A | A | A | A | Inv. |
| 4-7 | A | A | A | A | Inv. |
| 4-8 | A | A | A | A | Inv. |
| 4-9 | A | A | B | A | Inv. |

As is apparent from Table 5, the inventive samples having an ink receiving layer consisting of plural layers, the polyalkyleneoxide content Cx (weight %) of an outermost ink receiving layer and the polyalkyleneoxide content Cy (weight %) of an ink receiving layer other than the outermost ink receiving layer satisfying inequality Cx>Cy, provides high ink absorption and minimizes ink blurring, which is likely to occur during storage under high humidity.

EXAMPLE 5

The first coating solution containing the following first ink receiving layer composition, the second coating solution containing the following second ink receiving layer composition, the third coating solution containing the following third ink receiving layer composition and the fourth coating solution containing the following fourth ink receiving layer composition were prepared and coated on the support in that order to form a first layer, a second layer, a third layer and a fourth layer. Thus, samples 5-1 through 5-6 were obtained.

| <First ink receiving layer composition> | |
|---|---|
| Gelatin (Type KV-3000 produced by Konica Corporation) | as shown in Table 6 |
| PVP-K-90 (produced by BASF Co., Ltd.) | as shown in Table 6 |
| PEG 150000 (Arcox R150 produced by Meisei Kagaku Co., Ltd.) | as shown in Table 6 |

-continued

| | |
|---|---|
| Polymer latex (Exemplified Compound (1)) | as shown in Table 6 |
| Organic fine particle matting agent | 0.3 g/m$^2$ (in Sample No. 5-1)<br>0.13 g/m$^2$ (in Sample Nos. 5-2, 5-3 and 5-5)<br>0.05 g/m$^2$ (in Sample Nos. 5-4 and 5-6) |
| Surfactant FA-3 | 0.2% by weight of the first layer coating weight |
| Surfactant FK-8 | 0.2% by weight of the first layer coating weight |
| Surfactant F | 1.0% by weight of the first layer coating weight |
| <Second ink receiving layer composition> | |
| Gelatin (Type KV-3000 produced by Konica Corporation) | as shown in Table 6 |
| PVP-K-90 (produced by BASF Co., Ltd.) | as shown in Table 6 |
| PEG 150000 (Arcox R150 produced by Meisei Kagaku Co., Ltd.) | as shown in Table 6 |
| Poiymer latex (Exemplified Compound (1)) | as shown in Table 6 |
| <Third ink receiving layer composition> | |
| Gelatin (Type KV-3000 produced by Konica Corporation) | as shown in Table 6 |
| PVP-K-90 (produced by BASF Co., Ltd.) | as shown in Table 6 |
| PEG 150000 (Arcox R150 produced by Meisei Kagaku Co., Ltd.) | as shown in Table 6 |
| Polymer iatex (Exemplified Compound (1)) | as shown in Table 6 |
| <Fourth ink receiving layer composition> | |
| Gelatin (Type KV-3000 produced by Konica Corporation) | as shown in Table 6 |
| PVP-K-90 (produced by BASF Co., Ltd.) | as shown in Table 6 |
| PEG 150000 (Arcox R150 produced by Meisei Kagaku Co., Ltd.) | as shown in Table 6 |
| Polymer latex (Exemplified Compound (1)) | as shown in Table 6 |
| Fluorescent brightening agent E-34 | 0.62 g/m$^2$ |

An image was recorded on the samples obtained above in the same manner as in Example 4, except that an ink jet printer PC-Pr101, J180-5000C (produced by NEC Co., Ltd.) and an exclusive ink were used, and evaluated in the same manner as in Example 4.

The results are shown in Table 7.

TABLE 6

| Sample No. | Fourth 4, third 3, Second 2 and first 1 layers | Component content ratio (wt %) at each layer | | | | Component content (g/m$^2$) at each layer | | | | |
|---|---|---|---|---|---|---|---|---|---|---|
| | | Gelatin | PEG 150000 | PVP K-90 | Exemplified compound (1) | Gelatin | PEG 150000 | PVP K-90 | Exemplified compound (1) | Total coating amount |
| 5-1 | 4 | 50 | — | 50 | — | 4.25 | — | 4.25 | — | 8.5 |
| | 3 | — | — | — | — | — | — | — | — | — |
| | 2 | — | — | — | — | — | — | — | — | — |
| | 1 | 50 | — | 50 | — | 0.75 | — | 0.75 | — | 1.5 |
| | Sum | 50 | — | 50 | — | 5.0 | — | 5.0 | — | 10.0 |
| 5-2 | 4 | 33.4 | 33.4 | — | 33.1 | 1.17 | 1.17 | — | 1.16 | 3.5 |
| | 3 | — | — | — | — | — | — | — | — | — |
| | 2 | 33 | 20 | 13 | 34 | 1.65 | 1.0 | 0.65 | 1.70 | 5.0 |
| | 1 | 50 | — | 13.3 | 36.7 | 0.75 | — | 0.20 | 0.55 | 1.5 |
| | Sum | 35.7 | 21.7 | 8.5 | 34.1 | 3.57 | 2.17 | 0.85 | 3.41 | 10.0 |
| 5-3 | 4 | 50 | 30 | 20 | — | 1.75 | 1.05 | 0.70 | — | 3.5 |
| | 3 | — | — | — | — | — | — | — | — | — |

TABLE 6-continued

| Sample No. | Fourth 4, third 3, Second 2 and first 1 layers | Component content ratio (wt %) at each layer | | | | Component content ($g/m^2$) at each layer | | | | |
|---|---|---|---|---|---|---|---|---|---|---|
| | | Gelatin | PEG 150000 | PVP K-90 | Exemplified compound (1) | Gelatin | PEG 150000 | PVP K-90 | Exemplified compound (1) | Total coating amount |
| | 2 | 33.4 | — | 33.4 | 33.2 | 1.67 | — | 1.67 | 1.66 | 5.0 |
| | 1 | 50 | — | 13.3 | 36.7 | 0.75 | — | 0.20 | 0.55 | 1.5 |
| | Sum | 41.7 | 10.5 | 25.7 | 22.1 | 4.17 | 1.05 | 2.57 | 2.21 | 10.0 |
| 5-4 | 4 | 50 | 30 | 20 | — | 0.75 | 0.45 | 0.3 | — | 1.5 |
| | 3 | 50 | — | 50 | — | 1.0 | — | 1.0 | — | 2.0 |
| | 2 | 33.4 | — | 33.4 | 33.2 | 1.67 | — | 1.67 | 1.66 | 5.0 |
| | 1 | 50 | — | 13.3 | 36.7 | 0.75 | — | 0.20 | 0.55 | 1.5 |
| | Sum | 41.7 | 4.5 | 35.7 | 22.1 | 4.17 | 0.45 | 3.17 | 2.21 | 10.0 |
| 5-5 | 4 | 50 | 50 | — | — | 1.75 | 1.75 | — | — | 3.5 |
| | 3 | — | — | — | — | — | — | — | — | — |
| | 2 | 33.4 | — | 33.4 | 33.2 | 1.67 | — | 1.67 | 1.66 | 5.0 |
| | 1 | 50 | — | 13.3 | 36.7 | 0.75 | — | 0.20 | 0.55 | 1.5 |
| | Sum | 41.7 | 17.5 | 18.7 | 22.1 | 4.17 | 1.75 | 1.87 | 2.21 | 10.0 |
| 5-6 | 4 | 50 | 50 | — | — | 0.75 | 0.75 | — | — | 1.5 |
| | 3 | 50 | — | 50 | — | 1.0 | — | 1.0 | — | 2.0 |
| | 2 | 33.4 | — | 33.4 | 33.2 | 1.67 | — | 1.67 | 1.66 | 5.0 |
| | 1 | 50 | — | 13.3 | 36.7 | 0.75 | — | 0.2 | 0.55 | 1.5 |
| | Sum | 41.7 | 7.5 | 28.7 | 22.1 | 4.17 | 0.75 | 2.87 | 2.21 | 10.0 |

TABLE 7

| Sample No. | Glossiness | Banding | Ink absorption | Ink blurring | Remarks |
|---|---|---|---|---|---|
| 5-1 | D | C | C | D | Comp. |
| 5-2 | B | B | A | B | Inv. |
| 5-3 | A | A | B | B | Inv. |
| 5-4 | A | A | A | A | Inv. |
| 5-5 | A | A | A | B | Inv. |
| 5-6 | A | A | A | A | Inv. |

As is apparent from Table 5, the inventive samples having plural ink receiving layers, the polyalkyleneoxide and the polymer latex being not substantially present in the same ink receiving layer, minimize lowering of glossiness of printed images.

Inventive samples having plural ink receiving layers, the outermost layer containing the polyalkylene oxides, a first layer between the outermost layer and the support containing a polymer latex, and a second layer between the outermost layer and the first layer containing neither polyalkylene oxides nor polymer latex further minimize the above problem.

EXAMPLE 6

The first coating solution containing the following first ink receiving layer composition, the second coating solution containing the following second ink receiving layer composition, the third coating solution containing the following third ink receiving layer composition and the fourth coating solution containing the following fourth ink receiving layer composition were prepared and coated on the support in that order to form a first layer, a second layer, a third layer and a fourth layer. Thus, samples 6-1 through 6-8 were obtained.

| | |
|---|---|
| <First ink receiving layer composition> | |
| Gelatin (Type KV-3000 produced by Konica Corporation) | as shown in Tables 8 and 9 |
| PVP-K-90 (produced by BASF Co., Ltd.) | as shown in Tables 8 and 9 |
| PEG 150000 (Arcox R150 produced by Meisei Kagaku Co., Ltd.) | as shown in Tables 8 and 9 |
| Polymer latex (Exemplified Compound (1)) | as shown in Tables 8 and 9 |
| Organic fine particle matting agent | $0.3\ g/m^2$ (in Sample No. 6-1)<br>$0.13\ g/m^2$ (in Sample Nos. 6-2, 6-3 and 6-5)<br>$0.05\ g/m^2$ (in Sample Nos. 6-4 and 6-6)<br>$0.02\ g/m^2$ (in Sample Nos. 6-7 and 6-8) |
| Surfactant FA-3 | 0.2% by weight of the first layer coating weight |
| Surfactant FK-8 | 0.2% by weight of the first layer coating weight |
| Surfactant F | 1.0% by weight of the first layer coating weight |
| <Second ink receiving layer composition> | |
| Gelatin (Type KV-3000 produced by Konica Corporation) | as shown in Tables 8 and 9 |
| PVP-K-90 (produced by BASF Co., Ltd.) | as shown in Tables 8 and 9 |
| PEG 150000 (Arcox R150 produced by Meisei Kagaku Co., Ltd.) | as shown in Tables 8 and 9 |
| Polymer latex (Exemplified Compound (1)) | as shown in Tables 8 and 9 |
| <Third ink receiving layer composition> | |
| Gelatin (Type KV-300D produced by Konica Corporation) | as shown in Tables 8 and 9 |
| PVP-K-90 (produced by BASF Co., Ltd.) | as shown in Tables 8 and 9 |
| PEG 150000 (Arcox R150 produced by Meisei Kagaku Co., Ltd.) | as shown in Tables 8 and 9 |
| Polymer latex (Exemplified Compound (1)) | as shown in Tables 8 and 9 |
| <Fourth ink receiving layer composition> | |
| Gelatin (Type KV-3000 produced by Konica Corporation) | as shown in Tables 8 and 9 |

-continued

| | |
|---|---|
| PVP-K-90 (produced by BASF Co., Ltd.) | as shown in Tables 8 and 9 |
| PEG 150000 (Arcox R150 produced by Meisei Kagaku Co., Ltd.) | as shown in Tables 8 and 9 |
| Polymer latex (Exemplified Compound (1)) | as shown in Tables 8 and 9 |
| Fluorescent brightening agent E-34 | 0.62 g/m$^2$ |

The following back coat layer composition was coated on the surface of the support opposite the ink receiving layers.

| Back coat layer (BC layer) composition | |
|---|---|
| Gelatin (Type KV-3000 produced by Konica Corporation) | as shown in Tables 8 and 9 |
| Polymer latex (Exemplified Compound (1)) | as shown in Tables 8 and 9 |
| Organic fine particle matting agent | 8 weight % of the back coat layer coating weight |

An image was recorded on the samples as shown in Tables 8 and 9 in the same manner as in Example 4, except that an ink jet printer MCJ-5000 (produced by Epson Co., Ltd.) and an exclusive ink were used, and evaluated in the same manner as in Example 4. The satisfactory results were obtained in any evaluation. Further, the samples were evaluated according to the following evaluation method.

<Ink Transfer to the Back of the Sheet>

Ten minutes after ink images were printed on a sample sheet, a sample sheet not printed was placed on the sheet sample to bring into contact with the images and a 1 kg weight having an A4 size was further put on the sample sheet not printed, and then, time required to transfer the images on the back of the sample sheet not printed was evaluated according to the following evaluation criteria:

A: No ink image transfer after one month.

B: Slight ink transfer of the K images after one month, but there is no practical problem.

C: Slight ink transfer of the ink images after 5 hours.

D: Ink transfer of the full color ink images after 30 minutes.

<Transportability>

Fifty A4 size sheet smaples were continuously transported, and their transportability was evaluated according to the following evaluation criteria:

A: No problem.

B: During transporting, there occurred feeding failure for one or two sheets, but the sheets were properly fed after being inserted manually.

C: There occurred feeding failure at a rate of one sheet per ten sheets.

D: The sheets were fed by being inserted manually.

E: The sheets could be manually fed, but the sheet contacted the head during printing so that no image evaluation could not be carried out.

The results are shown in Table 10.

TABLE 8

| Sample No. | Fourth 4, third 3, Second 2 and first 1 layers | Component content ratio (wt %) at each layer | | | | Component content (g/m$^2$) at each layer | | | | |
|---|---|---|---|---|---|---|---|---|---|---|
| | | Gelatin | PEG 150000 | PVP K-90 | Exemplified compound (1) | Gelatin | PEG 150000 | PVP K-90 | Exemplified compound (1) | Total coating amount |
| 6-1 | 4 | 50 | — | 50 | — | 5.0 | — | 5.0 | — | 10.0 |
| | 3 | — | — | — | — | — | — | — | — | — |
| | 2 | — | — | — | — | — | — | — | — | — |
| | 1 | — | — | — | — | — | — | — | — | — |
| | Sum | 50 | — | 50 | — | 5.0 | — | 5.0 | — | 10.0 |
| | BC | 100 | — | — | — | 5.0 | — | — | — | 15.0 |
| 6-2 | 4 | 50 | — | 50 | — | 5.0 | — | 5.0 | — | 10.0 |
| | 3 | — | — | — | — | — | — | — | — | — |
| | 2 | — | — | — | — | — | — | — | — | — |
| | 1 | — | — | — | — | — | — | — | — | — |
| | Sum | 50 | — | 50 | — | 5.0 | — | 5.0 | — | 10.0 |
| | BC | 70 | — | — | 30 | 17.0 | — | — | 7.3 | 24.3 |
| 6-3 | 4 | 50 | — | 50 | — | 5.0 | — | 5.0 | — | 10.0 |
| | 3 | — | — | — | — | — | — | — | — | — |
| | 2 | — | — | — | — | — | — | — | — | — |
| | 1 | — | — | — | — | — | — | — | — | — |
| | Sum | 50 | — | 50 | — | 5.0 | — | 5.0 | — | 10.0 |
| | BC | 70 | — | — | 30 | 10.0 | — | — | 4.3 | 14.3 |
| 6-4 | 4 | 50 | — | 50 | — | 5.0 | — | 5.0 | — | 10.0 |
| | 3 | — | — | — | — | — | — | — | — | — |
| | 2 | — | — | — | — | — | — | — | — | — |
| | 1 | — | — | — | — | — | — | — | — | — |
| | Sum | 50 | — | 50 | — | 5.0 | — | 5.0 | — | 10.0 |
| | BC | 70 | — | — | 30 | 5.0 | — | — | 2.2 | 7.2 |

TABLE 9

| Sample No. | Fourth 4, third 3, Second 2 and first 1 layers | Component content ratio (wt %) at each layer | | | | Component content (g/m²) at each layer | | | | |
|---|---|---|---|---|---|---|---|---|---|---|
| | | Gelatin | PEG 150000 | PVP K-90 | Exemplified compound (1) | Gelatin | PEG 150000 | PVP K-90 | Exemplified compound (1) | Total coating amount |
| 6-5 | 4 | 50 | — | 50 | — | 5.0 | — | 5.0 | — | 10.0 |
| | 3 | — | — | — | — | — | — | — | — | — |
| | 2 | — | — | — | — | — | — | — | — | — |
| | 1 | — | — | — | — | — | — | — | — | — |
| | Sum | 50 | — | 50 | — | 5.0 | — | 5.0 | — | 10.0 |
| | BC | 100 | — | — | 30 | 2.5 | — | — | 1.1 | 3.6 |
| 6-6 | 4 | 50 | — | 50 | — | 5.0 | — | 5.0 | — | 10.0 |
| | 3 | — | — | — | — | — | — | — | — | — |
| | 2 | — | — | — | — | — | — | — | — | — |
| | 1 | — | — | — | — | — | — | — | — | — |
| | Sum | 50 | — | 50 | — | 5.0 | — | 5.0 | — | 10.0 |
| | BC | 70 | — | — | 30 | 2.0 | — | — | 0.9 | 2.9 |
| 6-7 | 4 | 50 | 50 | — | — | 0.75 | 0.75 | — | — | 1.5 |
| | 3 | 50 | — | 50 | — | 1.0 | — | 1.0 | — | 2.0 |
| | 2 | 33.4 | — | 33.4 | 33.2 | 1.67 | — | 1.67 | 1.66 | 5.0 |
| | 1 | 50 | — | 13.3 | 36.7 | 0.75 | — | 0.20 | 0.55 | 1.5 |
| | Sum | 41.7 | 7.5 | 28.7 | 22.1 | 4.17 | 0.75 | 2.87 | 2.21 | 10.0 |
| | BC | 70 | — | — | 30 | 5.18 | — | — | 1.82 | 7.4 |
| 6-8 | 4 | 50 | 30 | 20 | — | 0.75 | 0.45 | 0.30 | — | 1.5 |
| | 3 | 50 | — | 50 | — | 1.0 | — | 1.0 | — | 2.0 |
| | 2 | 33.4 | — | 33.4 | 33.2 | 1.67 | — | 1.67 | 1.66 | 5.0 |
| | 1 | 50 | — | 13.3 | 36.7 | 0.75 | — | 0.20 | 0.55 | 1.5 |
| | Sum | 41.7 | 4.5 | 31.7 | 22.1 | 4.17 | 0.45 | 3.17 | 2.21 | 10.0 |
| | BC | 70 | — | — | 30 | 5.18 | — | — | 1.82 | 7.4 |

TABLE 10

| Sample No. | Ce/Cb | Transport-ability | Ink transfer |
|---|---|---|---|
| 6-1 | 1.0 | D | D |
| 6-2 | 0.29 | C | C |
| 6-3 | 0.5 | B | B |
| 6-4 | 1.0 | A | A |
| 6-5 | 2.0 | A | A |
| 6-6 | 2.5 | C | C |
| 6-7 | 0.8 | A | A |
| 6-8 | 0.8 | A | A |

As is apparent from Table 10, the inventive samples having comprising a support, and an ink receiving layer provided thereon and a backing layer provided on the surface of the support opposite the ink receiving layer, each layer containing gelatin and a polymer latex, wherein the gelatin content Ce (weight %) of the ink receiving layer and the gelatin content Cb (weight %) of the backing layer satisfy inequality $0.3 \leqq Ce/Cb \leqq 2.0$, provide excellent transportability and minimize sheet adherence.

EXAMPLE 7

(1) Preparation of support

The following support was prepared.

a. The resin composition consisting of 70 parts of low density polyethylene and 20 parts of high density polyethylene was coated on one side of paper base having a basis weight of 140 g to be 30 g/m², and the resin composition consisting of 50 parts of low density polyethylene and 50 parts of high density polyethylene was coated on the other side of the paper base to be 30 g/m². Thus, a resin-covered paper was prepared.

b. The resin composition consisting of 70 parts of low density polyethylene and 20 parts of high density polyethylene was coated on one side of paper base having a basis weight of 80 g to be 15 g/m², and the resin composition consisting of 50 parts of low density polyethylene and 50 parts of high density polyethylene was coated on the other side of the paper base to be 15 g/m². Thus, a resin-covered paper was prepared.

c. a 95 μm thick polyethylene terephthalate film containing titanium oxide d. a 115 μm thick transparent polyethylene film e. a 160 μm thick cast coat film (2) Preparation of ink receiving layer and recording sheet sample The coating solution containing the following ink receiving layer composition was prepared and coated on the above support by a bar-coat method to give a dry thickness of the ink receiving layer of 9 g/m². Thus, a recording sheet samples 7-a through 7-e were obtained.

<Ink Receiving Layer Composition>

| | |
|---|---|
| Gelatin (Type KV-3000 produced by Konica Corporation) | 33 parts |
| PVP-K-90 (produced by BASF Co., Ltd.) | 13 parts |
| PEG 150000 (produced by Meisei Kagaku Co., Ltd.) | 20 parts |
| Exemplified Compound (1) | 33 parts |
| Surfactant FA | 0.5 parts |
| Surfactant FK | 0.5 parts |

Surfactant FA

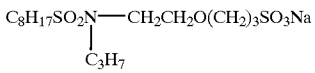

-continued

| |
|---|
| Surfactant FK |
| $C_8F_{17}SO_2NH(CH_2)_3\overset{+}{N}(CH_3)_3 \cdot I^-$ |

(3) Preparation of Printed Sample

Using an ink jet printer MJ-5000C (produced by Seiko Epson) and an exclusive ink, an image was recorded on the samples obtained above, and evaluated according to the following methods.

(Evaluation of Glossiness)

The black image portions K was observed and its glossiness was evaluated according to the following evaluation criteria:

(Evaluation Criteria)

A: No problem is evident

B: Glossiness is slightly inadequate, but there are no practical problems exhibited.

C: Glossiness is visibly lowered.

D: Glossiness is too low to be of practical use.

E: The sheets could be manually fed, but the sheet contacted the head during printing so that image evaluation could not be carried out.

(Taber stiffness)

The Taber stiffness of the support samples was measured according to JIS P-8125.

Comparative Example 7

The resin composition consisting of 70 parts of low density polyethylene and 20 parts of high density polyethylene was coated on one side of paper base having a basis weight of 50 g to be 12 g/m$^2$, and the resin composition consisting of 50 parts of low density polyethylene and 50 parts of high density polyethylene was coated on the other side of the paper base to be 12 g/m$^2$. Thus, a resin-covered paper was prepared. Test was carried out in the same manner as in Example 7, except that the above obtained paper was used as a support and Exemplified compound (1) was not used in the ink receiving layer.

The results of Example 7 and Comparative example 7 are shown in Table 11.

TABLE 11

| Example and Comparative Example | Example 7-a) | Example 7-b) | Example 7-c) | Example 7-d) | Example 7-e) | Comparative Example 7-a) | Comparative Example 7-b) | Comparative Example 7-c) | Comparative Example 7-d) | Comparative Example 7-e) |
|---|---|---|---|---|---|---|---|---|---|---|
| Teber stiffness (g · cm) | 11.2 | 1.1 | 2.6 | 3.8 | 7.2 | 11.2 | 1.1 | 2.6 | 3.8 | 7.2 |
| Ink absorption | A | A | A | A | A | B | B | B | B | B |
| Glossiness | A | A | A | —* | C | C | C | C | —* | D |
| Banding | B | A | A | A | A | C | C | C | C | C |
| Transportability (20° C., 80% RH) | B | A | A | A | A | C | D | C | C | C |
| Transportability (20° C., 30% RH) | B | A | A | A | A | D | E | D | D | D |

*Glossiness is not necessary, since the support is transparent.

(Evaluation of Banding)

The black image portions K was evaluated for banding according to the following evaluation criteria:

(Evaluation Criteria)

A: No banding is evident, and a uniform image was obtained.

B: Slight banding, but practically no problems.

C: Banding is observed at constant intervals.

D: Banding is observed over the entire image.

(Continuous transporting property)

<Transportability>

Forty A4 size sheet samples were continuously transported under conditions as shown in Tables 11, 12, 13 and 15, and their transportability was evaluated according to the following evaluation criteria:

A: No problem.

B: During transporting, there occurred feeding failure for one or two sheets, but the sheets were properly fed after being inserted manually.

C: There occurred feeding failure at a rate of one sheet per ten sheets.

D: The sheets could be fed only by being inserted manually.

As is apparent from Table 11, combined use of the support and the polymer latex in the invention provides excellent transportability under high or low humidity condition, high glossiness, high ink absorption and excellent anti-banding property.

EXAMPLE 8

The resin composition consisting of 70 parts of low density polyethylene and 20 parts of high density polyethylene was coated on one side of paper base having a basis weight of 110 g to be 25 g/m$^2$, and the resin composition consisting of 50 parts of low density polyethylene and 50 parts of high density polyethylene was coated on the other side of the paper base to be 25 g/m$^2$. Thus, a resin-covered paper having a teber stiffness according to JIS P-8125 of 8.2 g·cm was prepared.

The following coating composition for an ink receiving layer was coated on the above support in the same manner as in Example 7 to give a dry coating weight (g/m$^2$) as shown in Table 12 of each component of the ink receiving layer. Thus, a recording sheet samples 8-1 through 8-14 were obtained.

<Ink Receiving Layer Coating Composition>

Gelatin (Type KV-3000 produced by Konica Corporation)

PVP-K-90 (produced by BASF Co., Ltd.)

PEG 150000 (produced by Meisei Kagaku Co., Ltd.).

PVA GL-05 (produced by Nihon Goseikagaku Co., Ltd.)
Exemplified Compound (1)
Exemplified Compound (3)
Exemplified Compound (6)

Tests were carried out in the same manner as in Example 7. The results are shown in Table 12.

TABLE 12

| Example No. | 8-1 | 8-2 | 8-3 | 8-4 | 8-5 | 8-6 | 8-7 | 8-8 | 8-9 | 8-10 | 8-11 | 8-12 | 8-13 | 8-14 |
|---|---|---|---|---|---|---|---|---|---|---|---|---|---|---|
| Gelatin | 9 | — | — | 4.5 | 4.5 | 4.5 | 4.5 | — | — | 3 | 3 | 3 | 3 | 3 |
| PVP K-90 | — | 9 | — | 4.5 | — | — | — | 4.5 | — | 3 | — | — | — | — |
| PVA | — | — | 9 | — | 4.5 | — | — | — | 4.5 | — | 3 | — | — | — |
| PEG 150000 | — | — | — | — | — | 4.5 | — | — | — | — | — | 3 | 3 | 3 |
| Exemplified Compound (1) | — | — | — | — | — | — | 4.5 | 4.5 | 4.5 | 3 | 3 | 3 | — | — |
| Exemplified Compound (3) | — | — | — | — | — | — | — | — | — | — | — | — | 3 | — |
| Exemplified Compound (6) | — | — | — | — | — | — | — | — | — | — | — | — | — | 3 |
| Ink absorption | C | C | C | C | C | B | C | B | C | B | B | A | A | A |
| Glossiness | D | C | D | C | D | C | A | A | A | B | B | A | A | A |
| Banding | D | D | D | D | C | C | C | C | C | B | B | A | A | A |
| Transportability (20° C., 80% RH) | D | D | C | C | C | C | B | B | A | A | A | A | A | A |
| Transportability (20° C., 30% RH) | D | D | C | D | C | D | B | A | A | A | A | A | A | A |
| Remarks | Comp. | Comp. | Comp. | Comp. | Comp. | Comp. | Inv. | Inv. | Inv. | Inv. | Inv. | Inv. | Inv. | Inv. |

As is apparent from Table 12, use of the polymer latex in the invention provides excellent transportability under high or low humidity condition, high glossiness, high ink absorption and excellent anti-banding property. It has also been proved that combined use of the polymer latex in the invention, gelatin and a water soluble polymer heightens the effect of the invention.

EXAMPLE 9

Tests were carried out in the same manner as in Example 8, except that gelatin, PVP K-90, PEG 150000 and polymer latex in the ink receiving layer was coated to give a dry coating weight (g/m$^2$) as shown in Table 13.

The results are shown in Table 13.

TABLE 13

| Example No. | 9-1 | 9-2 | 9-3 | 9-4 | 9-5 | 9-6 | 9-7 |
|---|---|---|---|---|---|---|---|
| Gelatin | 6 | 6 | 5.9 | 5 | 4 | 3.5 | 3 |
| PVP K-90 | 6 | 3 | 2.8 | 2.5 | 2 | 1.8 | 1.2 |
| PEG 150000 | — | 3 | 2.8 | 2.5 | 2 | 1.8 | 1.2 |
| Exemplified Compound (1) | — | — | 0.5 | 2 | 4 | 4.9 | 6.6 |
| A/B | — | — | 0.85 | 0.4 | 1.0 | 1.4 | 2.2 |
| Ink absorption | C | B | B | A | A | B | B |
| Glossiness | D | C | B | A | A | A | B |
| Bading | D | C | B | A | A | A | B |
| Transportability (20° C., 80% HH) | C | C | B | A | A | A | B |
| Transportability (20° C., 30% HH) | D | D | B | A | A | A | B |
| Remarks | Comp. | Comp. | Inv. | Inv. | Inv. | Inv. | Inv. |

As is apparent from Table 13, inventive samples having a content ratio by weight of polymer latex to gelatin within the range of the invention heighten the effect of the invention.

EXAMPLE 10

The resin composition consisting of 70 parts of low density polyethylene and 20 parts of high density polyethylene was coated on one side of paper base having a basis weight of 90 g to be 20 g/m$^2$, and the resin composition consisting of 50 parts of low density polyethylene and 50 parts of high density polyethylene was coated on the other side of the paper base to be 20 g/m$^2$. Thus, a resin-covered paper having a teber stiffness of 2.8 g·cm was prepared.

The following first, second and third coating compositions for ink receiving layers were prepared and coated on the above support in that order to form a first layer, a second layer and a third layer according to a slide hopper method to give a dry coating weight (g/m$^2$) as shown in Table 14 of each of the ink receiving layers. Thus, a recording sheet sample No. 10 was prepared.

| | |
|---|---|
| <Third coating composition for ink receiving layer> | |
| Gelatin (Type KV-3000 produced by Konica Corporation) | 8 parts |
| PVP-K-90 (produced by BASF Co., Ltd.) | 24 parts |
| PEG 150000 (produced by Meisei Kagaku Co., Ltd.) | 24 parts |
| Organic fine particle matting agent (MR-13G produced by Soken Kagaku Co., Ltd.) | 2 parts |
| Surfactant FA | 0.5 parts |
| Surfactant FK | 0.5 parts |
| Surfactant FT | 1 part |
| <Second coating composition for ink receiving layer> | |
| Gelatin (Type KV-3000 produced by Konica Corporation) | 33 parts |
| PVP-K-90 (produced by BASF Co., Ltd.) | 33 parts |
| PEG 150000 (produced by Meisei Kagaku Co., Ltd.) | |
| Exemplified Compound (1) | 33 parts |
| <First coating composition for ink receiving layer> | |
| Gelatin (Type KV-3000 produced by Konica Corporation) | 53 parts |
| PVP-K-90 (produced by BASF Co., Ltd.) | 17 parts |
| PEG 150000 (produced by Meisei Kagaku Co., Ltd.) | |
| Exemplified Compound (1) | 33 parts |

The following back coat layer composition was coated on the surface of the support opposite the ink receiving layers.

| <Back coat layer (BC layer)> | |
|---|---|
| Gelatin (Type KV-3000 produced by Konica Corporation) | 64 parts |
| Exemplified Compound (1) | 28 parts |
| Surfactant FT | 0.5 parts |
| Organic fine particle matting agent (MR-13G produced by Soken Kagaku Co., Ltd.) | 3 parts |
| Hardener C | 4.5 parts |
| Surfactant FT | |

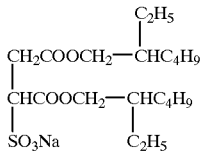

Hardener C

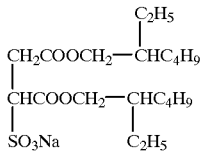

EXAMPLE 11

Recording sheet sample Nos. 11-1 and 11-2 were prepared in the same manner as in Example 10, except that each layer of the ink receiving layers was coated to give a dry weight as shown in Table 14.

EVALUATION (Evaluation on ink bleeding)

A character was printed with black ink on red, blue and green images at 25° C. and 80% RH, using the above obtained samples, and ink bleeding was evaluated according to the following evaluation criteria:

(Evaluation Criteria)

A: No ink bleeding observed at each color portion.

B: Slight ink bleeding occurred in complex types of printed characters, but the printed characters were still legible.

C: The printed characters were thickened and ink bleeding occurred, but the printed characters were legible.

D: Marked ink bleeding occurred, and the printed characters were illegible.

(Evaluation of gray gradation)

Printing was carried out using Y, M, C and K ink, with a gray gradation of 26 densities from white (background of paper) to black (maximum density) and the gradation was evaluated according to the following criteria:

(Evaluation Criteria)

A: No problem in gradation.

B: Portions of the gradation showed the same density, but no problem.

C: Several portions of the gradation showed the same density.

D: The densities were reversed in the gradation.

TABLE 14

| Sample No. | Third 3, second 2 and first 1 layers | Component content ratio (wt %) at each layer: Gelatin | PEG 150000 | PVP K-17 | Exemplified compound (1) | Component content ($g/m^2$) at each layer: Gelatin | PEG 150000 | PVP K-17 | Exemplified compound (1) | Total coating amount |
|---|---|---|---|---|---|---|---|---|---|---|
| 10 | 3 | 50 | 25 | 25 | | 1 | 0.5 | 0.5 | | 2 |
| | 2 | 33 | | 33 | 33 | 2.5 | | 2.5 | 2.5 | 7.5 |
| | 1 | 53 | | 13 | 33 | 0.8 | | 0.2 | 0.5 | 1.5 |
| | BC | 70 | — | — | 30 | 5.18 | — | — | 1.82 | |
| 11-1 | 3 | 33 | 20 | 20 | 17 | 0.67 | 0.4 | 0.4 | 0.53 | 2 |
| | 2 | 33 | | 33 | 33 | 2.5 | | 2.5 | 2.5 | 7.5 |
| | 1 | 50 | | 13 | 33 | 0.8 | | 0.2 | 0.5 | 1.5 |
| | BC | 70 | — | — | 30 | 5.18 | — | — | 1.82 | |
| 11-2 | 3 | 25 | 12.5 | 12.5 | 50 | 0.5 | 0.25 | 0.25 | 1 | 2 |
| | 2 | 33 | | 33 | 33 | 2.5 | | 2.5 | 2.5 | 7.5 |
| | 1 | 50 | | 13 | 33 | 0.8 | | 0.2 | 0.5 | 1.5 |
| | BC | 70 | — | — | 30 | 5.18 | — | — | 1.82 | |

The results are shown in Table 15.

TABLE 15

| Sample No. | Cb/Ce | Latex content in an outermost layer weight % | Glossiness | Banding | Ink absorption | Transportability (20° C., 15%) | Ink bleeding | Gray gradation |
|---|---|---|---|---|---|---|---|---|
| 10 | 1.2 | 0 | A | A | A | A | A | A |
| 11-1 | 1.3 | 17 | B | A | A | A | B | B |
| 11-2 | 1.36 | 50 | B | A | A | A | B | C |

As is apparent from Table 15, the inventive samples having plural ink receiving layers, the polymer latex content (weight %) of an outermost ink receiving layer being 40 weight % or less, minimizes ink bleeding and lowering of gray gradation in printing under high humidity condition.

EXAMPLE 12

(1) Preparation of Support

The resin composition consisting of 70 parts of low density polyethylene and 20 parts of high density polyethylene was coated on one side of paper base having a basis weight of 100 g to be 20 g/m$^2$, and the resin composition consisting of 50 parts of low density polyethylene and 50 parts of high density polyethylene was coated on the other side of the paper base to be 20 g/m$^2$. Thus, a support RC-1 (100 $\mu$m) was prepared.

(2) Preparation of Ink Receiving Layer and Recording Sheet Sample

The following fourth, third, second and first coating solutions were prepared and successively coated on the support according to a bar-coat method to give a total coating weight of the ink receiving layers of 10 g/m$^2$. Thus, samples 12-1 through 12-8 were obtained as shown in Tables 16 and 17.

The fourth, third, second and first coating solutions were coated on the support in that order to form a fourth layer, a third layer, a second layer and a first layer.

| <Fourth coating solution for ink receiving layer> | |
|---|---|
| Gelatin (Type KV-3000 produced by Konica Corporation) | as shown in Tables 16 and 17 |
| PVF-K-90 (produced by BASF Co., Ltd.) | as shown in Tables 16 and 17 |
| PEG 150000 (Arcox R150 producedby Meisei Kagaku Co., Ltd.) | as shown in Tables 16 and 17 |
| PEG 2000 (produced by Merck Co., Ltd.) | as shown in Tables 16 and 17 |
| Polyurethane F-8438D (produced by Daiichi Kogyoyakuhin) | as shown in Tables 16 and 17 |
| Polymer latex (Exemplified Compound (1)) | as shown in Tables 16 and 17 |
| Organic matting agent described later | 60 mg/m$^2$ |
| Surfactant FA | 0.2 weight % of the forth layer coating weight |
| Surfactant FK | 0.2 weight % of the forth layer coating weight |
| Surfactant FT | 1.0 weight % of the forth layer coating weight |

An aqueous coating solution containing the above components in a solid concentration of 7.5% (wt/vol) was prepared and adjusted to pH 8.0 with an aqueous 5% NaOH solution to obtain a fourth coating solution.

| <Third coating solution for ink receiving layer> | |
|---|---|
| Gelatin (Type KV-3000 produced by Konica Corporation) | as shown in Tables 16 and 17 |
| PVP-K-90 (produced by BASF Co., Ltd.) | as shown in Tables 16 and 17 |
| PEG 150000 (Arcox R150 produced by Meisei Kagaku Co., Ltd.) | as shown in Tables 16 and 17 |
| PEG 20000 (produced by Merck Co., Ltd.) | as shown in Tables 16 and 17 |
| Polyurethane F-8438D (produced by Daiichi Kogyoyakuhin) | as shown in Tables 16 and 17 |
| Polymer latex (Exemplified Compound (1)) | as shown in Tables 16 and 17 |

An aqueous coating solution containing the above components in a solid concentration of 7.5% (wt/vol) was prepared and adjusted to pH 8.0 with an aqueous 5% NaOH solution to obtain a third coating solution.

| <Second coating solution for ink receiving layer> | |
|---|---|
| Gelatin (Type KV-3000 produced by Konica Corporation) | as shown in Tables 16 and 17 |
| PVP-K-90 (produced by BASF Co., Ltd.) | as shown in Tables 16 and 17 |
| PEG 150000 (Arcox R150 produced by Meisei Kagaku Co., Ltd.) | as shown in Tables 16 and 17 |
| PEG 20000 (produced by Merck Co., Ltd.) | as shown in Tables 16 and 17 |
| Polyurethane F-8438D (produced by Daiichi Kogyoyakuhin) | as shown in Tables 16 and 17 |
| Polymer latex (Exemplified Compound (1)) | as shown in Tables 16 and 17 |

An aqueous coating solution containing the above components in a solid concentration of 7.5% (wt/vol) was prepared and adjusted to pH 8.0 with an aqueous 5% NaOH solution to obtain a second coating solution.

Organic Matting Agent

Methylmethacrylate-ethyleneglycol dimethacrylate copolymer (average particle diameter: 7–15$\mu$)

Brightening agent E

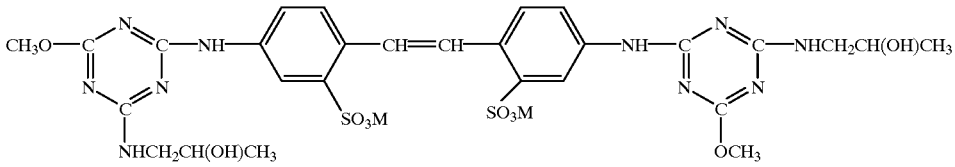

| <First coating solution for ink receiving layer> | |
|---|---|
| Gelatin (Type KV-3000 produced by Konica Corporation) | as shown in Tables 16 and 17 |
| PVP-K-90 (produced by BASF Co., Ltd.) | as shown in Tables 16 and 17 |
| PEG 150000 (Arcox R150 produced by Meisei Kagaku Co., Ltd.) | as shown in Tables 16 and 17 |
| PEG 2000 (produced by Merck Co., Ltd.) | as shown in Tables 16 and17 |
| Polyurethane F-8438D (produced by Daiichi Kogyoyakuhin) | as shown in Tables 16 and 17 |
| Polymer latex (Exemplified Compound (1)) | as shown in Tables 16 and 17 |
| Fluorescent brightening agent described above | 0.62 g/m$^2$ |

An aqueous coating solution containing the above components in a solid concentration of 7.5% (wt/vol) was prepared and adjusted to pH 8.0 with an aqueous 5% NaOH solution to obtain a first coating solution.

(3) Preparation of an Ink Receiving Layer and Measurement of an Ink Absorption Coefficient of the Ink Receiving Layer Each of the ink receiving layers of the samples in Table 16 was coated on the support as a single layer in the component content ratio shown in Table 16 to give a coating weight of 10 g/m$^2$. The ink absorption coefficient of the resulting sample was measured under the following conditions according to the Pristou test. Thus, ink absorption coefficient of each ink layer was obtained. The results are shown in Table 17.

| | |
|---|---|
| Test conditions: | 25° C., 40% RH |
| Ink used: | Magenta ink used in a printer, PC-PR101, J180 produced by NEC Co., Ltd. |

The component content (wt %) of each layer is shown in Table 16, and the component coating weight (g/m$^2$) of each layer is shown in Table 17.

TABLE 16

| | | Component content (wt %) at each layer | | | | | | |
|---|---|---|---|---|---|---|---|---|
| Sample No. | Layer No. | Gelatin | PVP K-90 1) | PEG 150000 2) | PEG 20000 3) | Polyur ethane | Polymer Latex | Re-marks |
| 12-1 | 1 | 50 | — | 50 | — | — | — | Comp. |
| 12-2 | 1 | 100 | — | — | — | — | — | Comp. |
| | 2 | 50 | 50 | — | — | — | — | |
| | Sum | 60 | 40 | — | — | — | — | |
| 12-3 | 1 | 50 | — | 50 | — | — | — | Inv. |
| | 2 | 50 | 50 | — | — | — | — | |
| | Sum | 50 | 40 | 10 | — | — | — | |
| 12-4 | 1 | 50 | — | 50 | — | — | — | Inv. |
| | 2 | 50 | 50 | — | — | — | — | |
| | 3 | 80 | 20 | — | — | — | — | |
| | Sum | 56 | 34 | 10 | — | — | — | |
| 12-5 | 1 | 50 | — | 50 | — | — | — | Inv. |
| | 2 | 50 | 50 | — | — | — | — | |
| | 3 | 33 | 33 | — | — | — | 33 | |
| | 4 | 80 | 20 | — | — | — | — | |
| | Sum | 49.3 | 27.3 | 10 | — | — | 13.3 | |
| 12-6 | 1 | 50 | 20 | 30 | — | — | — | Inv. |
| | 2 | 50 | 50 | — | — | — | — | |
| | 3 | 33 | 33 | — | — | — | 33 | |
| | 4 | 80 | 20 | — | — | — | — | |
| | Sum | 49.3 | 31.3 | 6.0 | — | — | 13.3 | |
| 12-7 | 1 | 40 | 25 | — | 10 | 25 | — | Inv. |
| | 2 | 40 | 25 | — | 5 | 30 | — | |
| | 3 | 40 | 30 | — | — | 30 | — | |
| | 4 | 80 | 20 | — | — | — | — | |
| | Sum | 48.0 | 26.0 | — | 30 | 23.0 | — | |
| 12-8 | 1 | 40 | 25 | — | 10 | 25 | — | Inv. |
| | 2 | 40 | 25 | — | 5 | 30 | — | |
| | 3 | 33 | 33 | — | — | — | 33 | |
| | 4 | 60 | 20 | — | — | — | — | |
| | Sum | 45.3 | 27.3 | — | 30 | 11.0 | 13.3 | |

1) Polyvinyl pyrroridone produced by BASF Co., Ltd.
2) Polyethylene glycol having an average molecular weight of 150,000 produced by Meisei Kagaku Co., Ltd.
3) Polyethylene glycol having an average molecular weight of 20,000 produced by Merck Co., Ltd.

TABLE 17

| Sample No. | Layer No. | Component coating weight ($g/m^2$) at each layer: Gelatin | PVP K-90 [1] | PEG 150000 [2] | PEG 20000 [3] | Polyurethane | Polymer Latex | Total content | Kα value $\times 10^{-6}$ ($m/sec^{1/2}$) |
|---|---|---|---|---|---|---|---|---|---|
| 12-1 | 1 | 5.0 | — | 5.0 | — | — | — | 10.0 | 7.78 |
| 12-2 | 1 | 2.0 | — | — | — | — | — | 2.0 | 5.17 |
| | 2 | 4.0 | 4.0 | — | — | — | — | 8.0 | 6.30 |
| | Sum | 6.0 | 4.0 | — | — | — | — | 10.0 | — |
| 12-3 | 1 | 1.0 | — | 1.0 | — | — | — | 2.0 | 7.78 |
| | 2 | 4.0 | 4.0 | — | — | — | — | 8.0 | 6.30 |
| | Sum | 5.0 | 4.0 | 1.0 | — | — | — | 10.0 | — |
| 12-4 | 1 | 1.0 | — | 1.0 | — | — | — | 2.0 | 7.78 |
| | 2 | 3.0 | 3.0 | — | — | — | — | 6.0 | 6.30 |
| | 3 | 1.6 | 0.4 | — | — | — | — | 2.0 | 5.51 |
| | Sum | 5.6 | 3.4 | 1.0 | — | — | — | 10.0 | — |
| 12-5 | 1 | 1.0 | — | 1.0 | — | — | — | 2.0 | 7.78 |
| | 2 | 1.0 | 1.0 | — | — | — | — | 2.0 | 6.30 |
| | 3 | 1.33 | 1.33 | — | — | — | 1.33 | 4.0 | 6.15 |
| | 4 | 1.6 | 0.4 | — | — | — | — | 2.0 | 5.51 |
| | Sum | 4.93 | 2.73 | 1.0 | — | — | 1.33 | 10.0 | — |
| 12-6 | 1 | 1.0 | 0.4 | 0.6 | — | — | — | 2.0 | 7.25 |
| | 2 | 1.0 | 1.0 | — | — | — | — | 2.0 | 6.30 |
| | 3 | 1.33 | 1.33 | — | — | — | 1.33 | 4.0 | 6.15 |
| | 4 | 1.6 | 0.4 | — | — | — | — | 2.0 | 5.51 |
| | Sum | 4.93 | 3.13 | 0.6 | — | — | 1.33 | 10.0 | — |
| 12-7 | 1 | 0.8 | 0.5 | — | 0.2 | 0.5 | — | 2.0 | 6.46 |
| | 2 | 0.8 | 0.5 | — | 0.1 | 0.6 | — | 2.0 | 6.20 |
| | 3 | 1.6 | 1.2 | — | — | 1.2 | — | 4.0 | 6.25 |
| | 4 | 1.6 | 0.4 | — | — | — | — | 2.0 | 5.51 |
| | Sum | 4.8 | 2.6 | — | 0.3 | 2.3 | — | 10.0 | — |
| 12-8 | 1 | 0.8 | 0.5 | — | 0.2 | 0.5 | — | 2.0 | 6.46 |
| | 2 | 0.8 | 0.5 | — | 0.1 | 0.6 | — | 2.0 | 6.20 |
| | 3 | 1.33 | 1.33 | — | — | — | 1.33 | 4.0 | 6.15 |
| | 4 | 1.6 | 0.4 | — | — | — | — | 2.0 | 5.51 |
| | Sum | 4.53 | 2.73 | — | 0.3 | 1.1 | 1.33 | 10.0 | — |

[1] Polyvinyl pyrroridone produced by BASF Co., Ltd.
[2] Polyethylene glycol having an average molecular weight of 150,000 produced by Meisei Kagaku Co., Ltd.
[3] Polyethylene glycol having an average molecular weight of 20,000 produced by Merck Co., Ltd.

An image was recorded on the sample Nos. 12-1 through 12-8 as shown in Table 16 using a printer, PC-PR101, J180 produced by NEC Co., Ltd. and an exclusive ink, and evaluated according to the following method.

(Evaluation of Banding)

The black image K was printed on the samples at 10° C. and 70% RH, and evaluated for banding according to the following evaluation criteria:

Evaluation Criteria

A: No banding, and a uniform image was obtained.

B: Slight banding, but practically no practical problems.

C: Banding is observed at constant intervals.

D: Banding is observed over entire image.

(Ink Absorption)

<Evaluation of Ink Absorptivity>

Three minutes and 10 minutes after B, G, R and K images were printed on the samples, commercially available wood free paper was brought into contact with the B, G, R and K images, and then, the degree of the ink image transfer to the back of the paper was evaluated according to the following evaluation criteria:

A: The contact carried out 3 minutes after printing results in slight ink transfer of K images, but the contact carried out 10 minutes after printing results in no ink transfer observed and therefore, there is no practical problem.

B: The contact carried out 3 minutes after printing results in slight ink transfer of the B, G, R and K images, but the contact carried out 10 minutes after printing results in no ink transfer and therefore, there is no practical problem.

C: The contact carried out 3 minutes after printing results in ink transfer at some of B, G, R and K images, and therefore, there is a problem.

(Ink bleeding)

A character was printed with black ink on the red, green and blue images on the above obtained samples, and the resulting samples were stored at 35° C. and 80% RH for 3 days, and ink bleeding was evaluated according to the following evaluation criteria:

Evaluation Criteria

A: No ink bleeding observed at each color portion, and the printed characters are legible.

B: Slight ink bleeding occurs in complex types of printed characters, but the printed characters are still legible.

C: The printed characters thicken and ink bleeding occurs, but the printed characters are legible.

D: Marked ink bleeding occurs, and the printed characters are illegible.

(Glossiness of images dried immediately after printing)

The black image K was printed on the samples shown in Tables 1 and 2 at 15° C. and 80% RH, dried at 15° C. and 30% RH, and glossiness was evaluated according to the following evaluation criteria:

Evaluation Criteria

A: No problem

B: Glossiness is slightly inadequate, but no practical problems.

C: Glossiness is apparently lowered.

D: Glossiness is too low to be of practical use.

The results are shown in Table 18.

TABLE 18

| Sample No. | Banding | Ink absorption | Ink bleeding | Glossiness of images dried immediately after printing | Remarks |
|---|---|---|---|---|---|
| 12-1 | A | A | D | C | Comp. |
| 12-2 | C | C | B–C | B | Comp. |
| 12-3 | A | A | B | B | Inv. |
| 12-4 | A | A | A | B | Inv. |
| 12-5 | A | A | A | A | Inv. |
| 12-6 | A | B | A | A | Inv. |
| 12-7 | B | B | A | A | Inv. |
| 12-8 | B | B | A | A | Inv. |

As is apparent from Tables 16, 17 and 18, the inventive samples having plural ink receiving layers, the ink absorption coefficient of an outermost ink receiving layer being not less than that of a layer other than the outermost layer, provides excellent ink absorption and ink fixibility in printing under low temperature and high humidity condition. It has also been proved that the inventive sample having three or more ink receiving layers provides more satisfactory results.

As is also apparent from Table 18, the inventive samples having plural ink receiving layers containing at least one polymer latex and/or at least one polyurethane minimizes lowering of glossiness of images, which is likely to occur particularly when dried immediately after printing under high humidity condition.

EXAMPLE 13

Tests were carried out in the same manner as in Example 12, except that kinds, the content ratio and the content of the water soluble polymer used were varied as shown in Tables 19 and 20. The content (wt %) and coating weight (g/m$^2$) of each polymer are shown in Tables 19 and 20, respectively.

TABLE 19

| | | Component content (wt %) at each layer | | | | | | | | |
|---|---|---|---|---|---|---|---|---|---|---|
| Sample No. | Layer No. | Gelatin | PVP K-90[1)] | PEG 150000[2)] | CMC [4)] | HPC [5)] | PVA [6)] | Polyacrylic acid K | Polymer Latex | Remarks |
| 13-1 | 1 | 50 | — | 50 | — | — | — | — | — | Comp. |
| 13-2 | 1 | 50 | — | 50 | — | — | — | — | — | Inv. |
| | 2 | 50 | 50 | — | — | — | — | — | — | |
| | 3 | 33 | 33 | — | — | — | — | — | 33 | |
| | 4 | 80 | 20 | — | — | — | — | — | — | |
| | Sum | 49.3 | 27.3 | 10 | — | — | — | — | 13.3 | |
| 13-3 | 1 | 50 | — | 50 | — | — | — | — | — | Inv. |
| | 2 | 50 | — | — | 50 | — | — | — | — | |
| | 3 | 33 | — | — | 33 | — | — | — | 33 | |
| | 4 | 80 | — | — | 20 | — | — | — | — | |
| | Sum | 49.3 | — | 10 | 27.3 | — | — | — | 13.3 | |
| 13-4 | 1 | 50 | — | — | 50 | — | — | — | — | Inv. |
| | 2 | 50 | — | — | — | 50 | — | — | — | |
| | 3 | 33 | — | — | — | 33 | — | — | 33 | |
| | 4 | 80 | — | — | — | 20 | — | — | — | |
| | Sum | 49.3 | — | — | 10.0 | 27.3 | — | — | 13.3 | |
| 13-5 | 1 | 50 | — | — | — | — | 50 | — | — | Inv. |
| | 2 | 50 | — | — | — | 50 | — | — | — | |
| | 3 | 33 | — | — | — | 33 | — | — | 33 | |
| | 4 | 80 | — | — | — | 20 | — | — | — | |
| | Sum | 49.3 | — | — | — | 27.3 | 10.0 | — | 13.3 | |
| 13-6 | 1 | 100 | — | — | — | — | — | — | — | Inv. |
| | 2 | 50 | — | — | — | — | — | 50 | — | |
| | 3 | 33 | — | — | — | — | — | 33 | 33 | |

TABLE 19-continued

| Sample No. | Layer No. | Component content (wt %) at each layer | | | | | | | | Remarks |
|---|---|---|---|---|---|---|---|---|---|---|
| | | Gelatin | PVP K-90[1)] | PEG 150000[2)] | CMC [4)] | HPC [5)] | PVA [6)] | Polyacrylic acid K | Polymer Latex | |
| | 4 | 80 | — | — | — | — | — | 20 | — | |
| | Sum | 59.3 | — | — | — | — | — | 27.3 | 13.3 | |

[1)]Polyvinyl pyrroridone produced by BASF Co., Ltd.
[2)]Polyethylene glycol having an average molecular weight of 150,000 produced by Meisei Kagaku Co., Ltd.
[4)]Carboxymethyl cellulose Celloken FSL produced by Daiichi Kogyoyakuhin Co., Ltd.
[5)]Hydroxypropyl cellulose TC-5 produced by Shinetsu Kagaku Co., Ltd.
[6)]Polyvinyl alcohol 6L-05 FSL prodcued by Nihon Goseikagaku Co., Ltd.

TABLE 20

| Sample No. | Layer No. | Component coating weight ($g/m^2$) at each layer | | | | | | | | | Ka value |
|---|---|---|---|---|---|---|---|---|---|---|---|
| | | Gelatin | PVP K-90 | PEG 150000 | CMC | HPC | PVA | Polyacrylic acid K | Polymer Latex | Total content | $\times 10^{-6}$ (m/sec½) |
| 13-1 | 1 | 5.0 | — | 5.0 | — | — | — | — | — | 10.0 | 7.78 |
| 13-2 | 1 | 1.0 | — | 1.0 | — | — | — | — | — | 2.0 | 7.78 |
| | 2 | 1.0 | 1.0 | — | — | — | — | — | — | 2.0 | 6.30 |
| | 3 | 1.33 | 1.33 | — | — | — | — | — | 1.33 | 4.0 | 6.15 |
| | 4 | 1.6 | 0.4 | — | — | — | — | — | — | 2.0 | 5.51 |
| | Sum | 4.93 | 2.73 | 1.0 | — | — | — | — | 1.33 | 10.0 | — |
| 13-3 | 1 | 1.0 | — | 1.0 | — | — | — | — | — | 2.0 | 7.78 |
| | 2 | 1.0 | — | — | 1.0 | — | — | — | — | 2.0 | 5.75 |
| | 3 | 1.33 | — | — | 1.33 | — | — | — | 1.33 | 4.0 | 5.88 |
| | 4 | 1.6 | — | — | 0.4 | — | — | — | — | 2.0 | 5.35 |
| | Sum | 4.93 | — | 1.0 | 2.73 | — | — | — | 1.33 | 10.0 | — |
| 13-4 | 1 | 1.0 | — | — | 1.0 | — | — | — | — | 2.0 | 5.75 |
| | 2 | 1.0 | — | — | — | 1.0 | — | — | — | 2.0 | 4.96 |
| | 3 | 1.33 | — | — | — | 1.33 | — | — | 1.33 | 4.0 | 5.11 |
| | 4 | 1.6 | — | — | — | 0.4 | — | — | — | 2.0 | 4.80 |
| | Sum | 4.93 | — | — | 1.0 | 2.73 | — | — | 1.33 | 10.0 | — |
| 13-5 | 1 | 1.0 | — | — | — | — | 1.0 | — | — | 2.0 | 5.40 |
| | 2 | 1.0 | — | — | — | 1.0 | — | — | — | 2.0 | 4.95 |
| | 3 | 1.33 | — | — | — | 1.33 | — | — | 1.33 | 4.0 | 5.11 |
| | 4 | 1.6 | — | — | — | 0.4 | — | — | — | 2.0 | 4.80 |
| | Sum | 4.93 | — | — | — | 2.73 | 1.0 | — | 1.33 | 10.0 | — |
| 13-6 | 1 | 2.0 | — | — | — | — | — | — | — | 2.0 | 5.35 |
| | 2 | 1.0 | — | — | — | — | — | 1.0 | — | 2.0 | 5.10 |
| | 3 | 1.33 | — | — | — | — | — | 1.33 | 1.33 | 4.0 | 5.08 |
| | 4 | 1.6 | — | — | — | — | — | 0.4 | — | 2.0 | 4.71 |
| | Sum | 5.93 | — | — | — | — | — | 2.73 | 1.33 | 10.0 | — |

The results are shown in Table 21.

TABLE 21

| Sample No. | Banding | Ink absorption | Ink bleeding | Glossiness of images dried immediately after printing | Remarks |
|---|---|---|---|---|---|
| 13-1 | A | A | D | C | Comp. |
| 13-2 | A | A | A | A | Inv. |
| 13-3 | A | B | A | A | Inv. |
| 13-4 | B | B | B | A | Inv. |
| 13-5 | B | B | B | A | Inv. |
| 13-6 | B–C | B | B | B | Inv. |

As is apparent from Table 21, the inventive samples having plural ink receiving layers containing, as a water soluble polymer, at least one polymer selected from the group consisting of polyalkylene oxides, polyvinyl pyrrolidones, polyvinyl alcohols, hydroxypropyl celluloses and carboxymethyl celluloses, provides the effects of the invention, and polyalkylene oxides or polyvinyl pyrrolidones provide more preferable results.

EXAMPLE 14

Tests were carried out in the same manner as in Example 12, except that kinds of a water soluble polymer used, the content (wt %) of the polymer used and gelatin, and the coating weight (g/m$^2$) of each of the components used were varied as shown in Table 22.

The results are shown in Table 23.

TABLE 22

| Sample No. | Layer | Component content (wt %) at each layer: Gelatin | PVK K-90 | PEG 150000 | Polymer latex | Component coating weight (g/m$^2$) at each layer: Gelatin | PVK K-90 | PEG 150000 | Polymer latex | Total coating amount |
|---|---|---|---|---|---|---|---|---|---|---|
| 14-1 | 5 | 50 | — | 50 | — | — | — | — | — | 10.0 |
| 14-2 | 1 | 80 | — | 20 | — | 1.6 | — | 0.4 | — | 2.0 |
| | 2 | 100 | — | — | — | 2.0 | — | — | — | 2.0 |
| | 3 | 66 | — | — | 33 | 2.66 | — | — | 1.33 | 4.0 |
| | 4 | 100 | — | — | — | 2.0 | — | — | — | 2.0 |
| | Sum | 82.6 | — | 4.0 | 13.3 | 8.26 | — | 0.4 | 1.33 | 10.0 |
| 14-3 | 1 | 70 | — | 30 | — | 1.4 | — | 0.6 | — | 2.0 |
| | 2 | 90 | 20 | — | — | 1.6 | 0.4 | — | — | 2.0 |
| | 3 | 66 | — | — | 33 | 2.66 | — | — | 1.33 | 4.0 |
| | 4 | 100 | — | — | — | 2.0 | — | — | — | 2.0 |
| | Sum | 76.8 | 40 | 6.0 | 13.3 | 7.68 | 0.4 | 0.6 | 1.33 | 10.0 |
| 14-4 | 1 | 50 | 20 | 30 | — | 1.0 | 0.4 | 0.6 | — | 2.0 |
| | 2 | 50 | 50 | — | — | 1.0 | 1.0 | — | — | 2.0 |
| | 3 | 33 | 33 | — | 33 | 1.33 | 1.33 | — | 1.33 | 4.0 |
| | 4 | 80 | 20 | — | — | 1.6 | 0.4 | — | — | 2.0 |
| | Sum | 49.3 | 31.3 | 6.0 | 13.3 | 4.93 | 3.13 | 0.6 | 1.33 | 10.0 |
| 14-5 | 1 | 30 | — | 70 | — | 0.6 | — | 1.4 | — | 2.0 |
| | 2 | 30 | 70 | — | — | 0.6 | 1.4 | — | — | 2.0 |
| | 3 | 15 | 55 | — | 30 | 0.6 | 2.2 | — | 1.2 | 4.0 |
| | 4 | 30 | 70 | — | — | 0.6 | 1.4 | — | — | 2.0 |
| | Sum | 24.0 | 50.0 | 14.0 | 12.0 | 2.4 | 5.0 | 1.4 | 1.2 | 10.0 |
| 14-6 | 1 | 20 | — | 80 | — | 0.4 | — | 1.6 | — | 2.0 |
| | 2 | 20 | 80 | — | — | 0.4 | 1.6 | — | — | 2.0 |
| | 3 | 15 | 55 | — | 30 | 0.6 | 2.2 | — | 1.2 | 4.0 |
| | 4 | 20 | 80 | — | — | 0.4 | 1.6 | — | — | 2.0 |
| | Sum | 18.0 | 54.0 | 16.0 | 12.0 | 1.8 | 5.8 | 1.6 | 1.2 | 10.0 |

TABLE 23

| Sample No. | Layer | Ka value $\times 10^{-6}$ (m/sec$^{1/2}$) | Water soluble polymer/gelatin (weight ratio) | Banding | Ink absorption | Ink bleeding | Glossiness of images dried immediately after printing | Re-marks |
|---|---|---|---|---|---|---|---|---|
| 14-1 | 5 | 7.78 | 1.0 | A | A | D | C | Comp. |
| 14-2 | 1 | 6.10 | 0.05 | B–C | B–C | B | A | Inv. |
| | 2 | 5.35 | | | | | | |
| | 3 | 5.40 | | | | | | |
| | 4 | 5.35 | | | | | | |
| | Sum | — | | | | | | |
| 14-3 | 1 | 6.72 | 0.13 | B | B | B | A | Inv. |
| | 2 | 5.51 | | | | | | |
| | 3 | 5.40 | | | | | | |
| | 4 | 5.35 | | | | | | |
| | Sum | — | | | | | | |
| 14-4 | 1 | 7.25 | 0.75 | A | A | A | A | Inv. |
| | 2 | 6.30 | | | | | | |
| | 3 | 6.15 | | | | | | |
| | 4 | 5.51 | | | | | | |
| | Sum | — | | | | | | |
| 14-5 | 1 | 8.80 | 2.67 | A | B | B | A | Inv. |
| | 2 | 6.91 | | | | | | |
| | 3 | 6.88 | | | | | | |
| | 4 | 6.91 | | | | | | |
| | Sum | — | | | | | | |
| 14-6 | 1 | 9.40 | 3.89 | A | B | B–C | B | Inv. |
| | 2 | 7.10 | | | | | | |
| | 3 | 6.88 | | | | | | |
| | 4 | 7.10 | | | | | | |
| | Sum | — | | | | | | |

As is apparent from Table 23, the inventive samples having plural ink receiving layers containing a water soluble polymer and gelatin, the content ratio of the water soluble polymer to gelatin being 0.1 to 3.0, provide more preferable results.

What is claimed is:

1. A recording sheet for ink-jet recording comprising a support, and provided thereon, at least one ink receiving layer, containing a water soluble polymer, a polymer latex and gelatin, wherein the water soluble polymer is a polyalkylene oxide, a polyvinyl pyrrolidone or a polyvinyl alcohol.

2. The recording sheet for ink-jet recording of claim 1, wherein the water soluble polymer is a polyalkylene oxide.

3. The recording sheet for ink-jet recording of claim 2, wherein the polyalkylene oxide is polyethylene glycol.

4. The recording sheet for ink-jet recording of claim 1, wherein the polymer latex content A ($g/m^2$) of the ink receiving layer and the gelatin content B ($g/m^2$) of the ink receiving layer satisfy the following inequality:

$$0.1<A/B<2.0$$

5. The recording sheet for ink-jet recording of claim 1, wherein there are more than one ink receiving layers and polyalkylene oxide and polymer latex are present in different layers.

6. The recording sheet for ink-jet recording of claim 5, wherein an outermost layer contains the polyalkylene oxide, a first layer between the outermost layer and the support contains a polymer latex, and a second layer between the outermost layer and the first layer contains neither polyalkylene oxide nor polymer latex.

7. The recording sheet for ink-jet recording of claim 5, wherein the polyalkylene oxide content Cx (weight %) of an outermost ink receiving layer and the polyalkylene oxide content Cy (weight %) of an ink receiving layer other than the outermost ink receiving layer satisfy the following inequality:

$$Cx>Cy.$$

8. The recording sheet for ink-jet recording of claim 1, further comprising a backing layer provided on the surface of the support opposite the ink receiving layer, wherein the backing layer contains gelatin and a polymer latex, the gelatin content Ce (weight %) of the ink receiving layer and the gelatin content Cb (weight %) of the backing layer satisfy the following relation:

$$0.3\leqq Ce/Cb\leqq 2.0.$$

9. The recording sheet for ink-jet recording of claim 1, wherein the support has a Taber stiffness of 0.7 to 20 g·cm.

10. The recording sheet for ink-jet recording of claim 1, wherein there is a plurality of ink receiving layers and in quantity of n and the following relation is satisfied:

$$\kappa\alpha_{1\geqq\kappa\alpha 2}, \ldots \kappa\alpha_n$$

wherein $\kappa\alpha_1$ ($m/sec^{1/2}$) represents an ink absorption coefficient of an outermost ink receiving layer, $\kappa\alpha_2$ ($m/sec^{1/2}$), . . . $\kappa\alpha_n$ ($m/sec^{1/2}$) represent ink absorption coefficients of ink receiving layers other than the outermost ink receiving layer and n represents an integer of 2 or more.

* * * * *